US010311798B2

(12) United States Patent
Lee et al.

(10) Patent No.: US 10,311,798 B2
(45) Date of Patent: Jun. 4, 2019

(54) ORGANIC LIGHT EMITTING DIODE DISPLAY AND METHOD FOR CONTROLLING LUMINANCE THEREOF

(71) Applicant: LG DISPLAY CO., LTD., Seoul (KR)

(72) Inventors: Hyunjae Lee, Goyang-si (KR); Taeyoung Park, Anyang-si (KR); Dongsup Shim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 93 days.

(21) Appl. No.: 14/975,093

(22) Filed: Dec. 18, 2015

(65) Prior Publication Data

US 2016/0189635 A1 Jun. 30, 2016

(30) Foreign Application Priority Data

Dec. 29, 2014 (KR) ..... 10-2014-0192641

(51) Int. Cl.

| | |
|---|---|
| ***G09G 3/30*** | (2006.01) |
| ***G09G 3/3291*** | (2016.01) |
| ***G09G 3/3233*** | (2016.01) |
| *G09G 3/20* | (2006.01) |

(52) U.S. Cl.

CPC ..... *G09G 3/3291* (2013.01); *G09G 3/3233* (2013.01); *G09G 3/2003* (2013.01); *G09G 2300/0852* (2013.01); *G09G 2300/0861* (2013.01); *G09G 2310/0262* (2013.01); *G09G 2310/08* (2013.01); *G09G 2320/0666* (2013.01); *G09G 2320/0673* (2013.01); *G09G 2320/08* (2013.01); *G09G 2330/028* (2013.01)

(58) Field of Classification Search

CPC ..... G09G 2300/043; G09G 2320/0242–048
USPC ..... 345/76–82
See application file for complete search history.

(56) References Cited

U.S. PATENT DOCUMENTS

| | | | | |
|---|---|---|---|---|
| 2008/0158113 | A1* | 7/2008 | Ozawa | G09G 3/3406 345/77 |
| 2013/0249955 | A1* | 9/2013 | Kim | G09G 3/3233 345/690 |
| 2013/0321486 | A1* | 12/2013 | Cha | G09G 5/10 345/690 |

* cited by examiner

*Primary Examiner* — Roy P Rabindranath
(74) *Attorney, Agent, or Firm* — Birch, Stewart, Kolasch & Birch, LLP

(57) ABSTRACT

An organic light emitting diode display includes pixels in which an amount of current flowing in an organic light emitting diode of each pixel is determined depending on a difference between a data voltage and a reference voltage, a control signal generator differently generating a screen brightness control signal depending on a driving mode, a register adjusting unit independently adjusting a reference voltage register value and a gamma register value at each of red (R), green (G), and blue (B) pixels depending on the screen brightness control signal, a reference voltage generator generating the reference voltage of each of the R, G, and B colors based on the reference voltage register value, and a data voltage generator generating the data voltage of each of the R, G, and B colors based on the gamma register value.

25 Claims, 25 Drawing Sheets

| Band | Luminance | DBV | Vref | | |
|---|---|---|---|---|---|
| | | | R | G | B |
| 1 | 1000 | 1023 | 0.4 | 0.5 | 0.6 |
| 2 | 300 | 851 | 1.6 | 1.8 | 1.5 |
| 3 | 200 | 708 | 1.7 | 1.9 | 1.6 |
| 4 | 140 | 602 | 1.8 | 2.0 | 1.7 |
| 5 | 50 | 377 | 1.9 | 2.1 | 1.8 |
| 6 | 15 | 218 | 2.0 | 2.2 | 1.9 |
| 7 | 1.5 | 77 | 2.1 | 2.3 | 2.0 |

| | Ti | Ts | Tw | Te |
|---|---|---|---|---|
| SW1 | OFF | OFF | ON | OFF |
| SW2 | OFF | OFF | ON | OFF |
| SW3 | OFF | OFF | ON | OFF |
| SW4 | ON | ON | OFF | ON |
| SW5 | ON | ON | OFF | ON |
| SW6 | ON | ON | OFF | ON |

FIG. 16

| | Ti-1 | Ti-2 | Ti-3 | Ts | Tw-1 | Tw-2 | Tw-3 | Te |
|---|---|---|---|---|---|---|---|---|
| SW1 | OFF | OFF | OFF | OFF | ON | OFF | OFF | OFF |
| SW2 | OFF | OFF | OFF | OFF | OFF | ON | OFF | OFF |
| SW3 | OFF | OFF | OFF | OFF | OFF | OFF | ON | OFF |
| SW4 | ON | OFF | OFF | OFF | OFF | OFF | OFF | OFF |
| SW5 | OFF | ON | OFF | OFF | OFF | OFF | OFF | OFF |
| SW6 | OFF | OFF | ON | OFF | OFF | OFF | OFF | OFF |
| MUX1 | ON | OFF | OFF | OFF | ON | OFF | OFF | OFF |
| MUX2 | OFF | ON | OFF | OFF | OFF | ON | OFF | OFF |
| MUX3 | OFF | OFF | ON | OFF | OFF | OFF | ON | OFF |
| Scan1 | ON | ON | ON | ON | ON | ON | ON | OFF |
| Scan2 | ON | OFF | OFF | OFF | OFF | OFF | OFF | OFF |

FIG. 20

| ALS | Vref_R | |
|---|---|---|
| 255 | 0.400V | |
| 254 | 0.405V | 5mV Step |
| 253 | 0.410V | |
| ... | ... | |
| 3 | 1.585V | |
| 2 | 1.590V | |
| 1 | 1.595V | |
| 0 | 1.600V | |

| ALS | Vref_G | |
|---|---|---|
| 255 | 0.500V | |
| 254 | 0.505V | 5mV Step |
| 253 | 0.510V | |
| ... | ... | |
| 3 | 1.785V | |
| 2 | 1.790V | |
| 1 | 1.795V | |
| 0 | 1.800V | |

| ALS | Vref_B | |
|---|---|---|
| 255 | 0.600V | |
| 254 | 0.605V | 5mV Step |
| 253 | 0.610V | |
| ... | ... | |
| 3 | 1.485V | |
| 2 | 1.490V | |
| 1 | 1.495V | |
| 0 | 1.500V | |

ORGANIC LIGHT EMITTING DIODE DISPLAY AND METHOD FOR CONTROLLING LUMINANCE THEREOF

This application claims the priority benefit of Korean Patent Application No. 10-2014-0192641 filed on Dec. 29, 2014, which is incorporated herein by reference for all purposes as if fully set forth herein.

BACKGROUND OF THE INVENTION

Field of the Invention

Embodiments of the invention relate to an active matrix organic light emitting diode (OLED) display and a method for controlling a luminance thereof.

Discussion of the Related Art

An active matrix organic light emitting diode (OLED) display includes organic light emitting diodes (OLEDs) capable of emitting light by itself and has advantages of a fast response time, a high emission efficiency, a high luminance, a wide viewing angle, and the like.

The OLED serving as a self-emitting element includes an anode, a cathode, and an organic compound layer formed between the anode and the cathode. The organic compound layer includes a hole injection layer HIL, a hole transport layer HTL, an emission layer EML, an electron transport layer ETL, and an electron injection layer EIL. When a driving voltage is applied to the anode and the cathode, holes passing through the hole transport layer HTL and electrons passing through the electron transport layer ETL move to the emission layer EML and form excitons. As a result, the emission layer EML generates visible light.

The OLED display arranges pixels each including the OLED in a matrix form and adjusts a luminance of the pixels depending on grayscale of video data. Each pixel may include a driving thin film transistor (TFT) controlling a driving current flowing in the OLED depending on a gate-to-source voltage of the driving TFT, a capacitor keeping the gate-to-source voltage of the driving TFT constant during one frame, and at least one switching TFT programming the gate-to-source voltage of the driving TFT in response to a gate signal. A luminance of the pixel is proportional to a magnitude of the driving current flowing in the OLED.

In recent years, as the OLED display is applied to a mobile device or a wearable smart device, etc., various attempts have been made to improve outdoor visibility.

To improve the outdoor visibility, as shown in FIG. 1, a method for adjusting a gamma curve to modulate input video data has been known. Because a brightness of peripheral light in an outdoor environment is generally greater than a brightness of peripheral light in an indoor environment, the OLED display must be able to implement a high luminance so as to improve the outdoor visibility. However, because the highest gray level is fixed to a specific luminance value in the method for modulating the input video data, it is difficult to implement a higher luminance than the specific luminance of the highest gray level. Further, the detailed representation is reduced due to a loss of gray scale, and so-called dot noise may be generated at low gray levels.

A method for increasing an uppermost gamma reference voltage generated from an internal gamma string of a data driver to implement the high luminance has been known. However, an increase in the uppermost gamma reference voltage increases a range of a data voltage generated by dividing the uppermost gamma reference voltage. This leads to an increase in a swing width of the data voltage output from each channel of the data driver. When the output swing width of the data voltage increases, power consumption of the data driver increases, and an output buffer of the data driver has to be re-designed as a high voltage element. Hence, the size of the data driver needs to be increased. Thus, it is difficult to apply the above-described methods for implementing the high luminance to the mobile device and the wearable smart device, which have a small size and small battery capacity.

SUMMARY OF EMBODIMENTS OF THE INVENTION

Accordingly, embodiments of the invention provide an organic light emitting diode (OLED) display and a method for controlling a luminance thereof capable of implementing a high luminance mode without changes in a gamma structure.

In one aspect, there is provided an organic light emitting diode display comprising pixels each including an organic light emitting diode, an amount of current flowing in the organic light emitting diode being determined depending on a difference between a data voltage and a reference voltage; a control signal generator configured to differently generate a screen brightness control signal depending on a driving mode; a register adjusting unit configured to independently adjust a reference voltage register value and a gamma register value at each of red (R), green (G), and blue (B) pixels depending on the screen brightness control signal; a reference voltage generator configured to generate the reference voltage of each of the R, G, and B colors based on the reference voltage register value; and a data voltage generator configured to generate the data voltage of each of the R, G, and B colors based on the gamma register value.

In another aspect, there is provided a method for controlling a luminance of an organic light emitting diode display including pixels, in which an amount of current flowing in an organic light emitting diode of each pixel is determined depending on a difference between a data voltage and a reference voltage, the method comprising: differently generating a screen brightness control signal depending on a driving mode; independently adjusting a reference voltage register value and a gamma register value at each of red (R), green (G), and blue (B) pixels depending on the screen brightness control signal; generating the reference voltage of each of the R, G, and B colors based on the reference voltage register value; and generating the data voltage of each of the R, G, and B colors based on the gamma register value.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 16 shows on-timing and off-timing of switches shown in FIG. 15;

FIG. 20 shows reference voltages mapped to digital illuminance information at each of R, G, and B colors according to an embodiment of the invention;

DETAILED DESCRIPTION OF THE EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

Exemplary embodiments of the invention will be described with reference to FIGS. 2 to 22.

Figure 1:
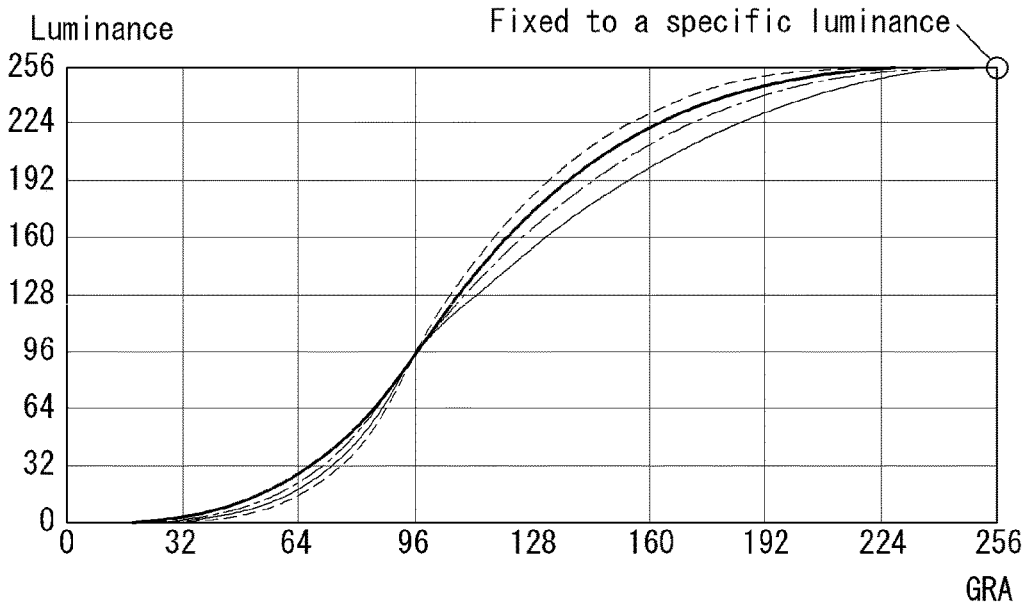
FIG. 1 (RELATED ART)
FIG. 1 illustrates a related art method for adjusting a gamma curve and modulating input video data.
Figure 2:
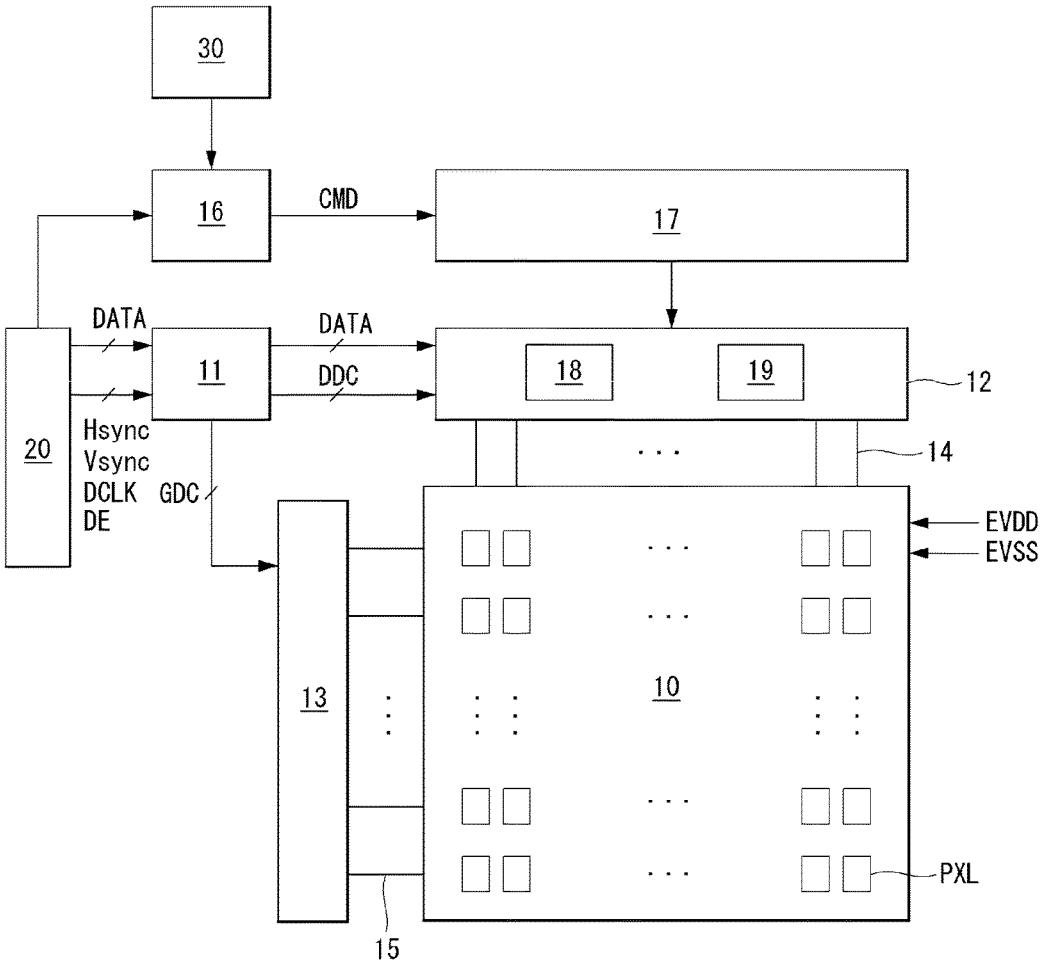
FIG. 2 shows an organic light emitting diode (OLED) display according to an embodiment of the invention.

FIG. 2 shows an organic light emitting diode (OLED) display according to an exemplary embodiment of the invention. All the components of the OLED display according to all the embodiments of the invention are operatively coupled and configured.

As shown in FIG. 2, the OLED display according to the embodiment of the invention includes a display panel 10, a timing controller 11, a data driver 12, a gate driver 13, a control signal generator 16, a register adjusting unit 17, a reference voltage generator 18, a data voltage generator 19, and a system 20. The OLED display according to the embodiment of the invention may further include an illuminance sensor 30.

On the display panel 10, a plurality of data lines 14 and a plurality of gate lines 15 cross each other, and pixels PXL are respectively at crossings of the data lines 14 and the gate lines 15 in a matrix form. Each gate line 15 may include at least one scan line depending on a structure of the pixel PXL and may further include an emission line, if necessary or desired. The pixels PXL may receive a high potential power voltage EVDD and a low potential power voltage EVSS from a power generator and may further receive an initialization voltage, if necessary or desired. It is preferable, but not required, that the initialization voltage is selected within a range sufficiently less than the low potential power voltage EVSS so that an organic light emitting diode (OLED) of each pixel PXL is prevented or minimized from unnecessarily emitting light.

Thin film transistors (TFTs) constituting the pixel PXL may be implemented as an oxide TFT including an oxide semiconductor layer. The oxide TFT is advantageous for a large sized display panel 10 considering various factors, such as an electron mobility, a process deviation, etc. However, the embodiment of the invention is not limited thereto. For example, the semiconductor layer of the TFT may be formed of amorphous silicon or polycrystalline silicon.

The pixels PXL include a red (hereinafter, referred to as "R") pixel including a red emission layer and representing a red color, a green (hereinafter, referred to as "G") pixel including a green emission layer and representing a green color, and a blue (hereinafter, referred to as "B") pixel including a blue emission layer and representing a blue color. Each pixel PXL includes a plurality of TFTs for compensating for changes in a threshold voltage of a driving TFT and capacitors. A reference voltage is supplied to each pixel PXL, so as to compensate for the changes in the threshold voltage of the driving TFT. When the changes in the threshold voltage of the driving TFT are compensated by a switching operation inside the pixel PXL, an amount of current flowing in the OLED of the pixel PXL is determined depending on a difference between a data voltage and the reference voltage irrespective of the threshold voltage of the driving TFT. Examples of configuration and an operation of the pixel PXL are described with reference to FIGS. 3 to 8C.

The timing controller 11 rearranges digital video data DATA received from the system 20 in conformity with a resolution of the display panel 10 and supplies the rearranged digital video data DATA to the data driver 12. The timing controller 11 generates a data control signal DDC for controlling operation timing of the data driver 12 and a gate control signal GDC for controlling operation timing of the gate driver 13 based on timing signals, such as a vertical sync signal Vsync, a horizontal sync signal Hsync, a dot clock DCLK, and a data enable signal DE.

The data driver 12 converts the digital video data DATA received from the timing controller 11 into an analog data voltage based on the data control signal DDC. The data driver 12 supplies the data voltage to the data lines 14.

The gate driver 13 generates a gate signal based on the gate control signal GDC and then may sequentially supply the gate signal to the gate lines 15 in a sequential line manner. In the embodiment disclosed herein, the gate signal may include at least one scan signal and also may include a scan signal and an emission signal. The gate driver 13 may be directly formed on a non-display area of the display panel 10 through a gate driver-in panel (GIP) process.

When the system 20 receives information related to the control of screen brightness from a user, the system 20 supplies the user input information to the control signal generator 16. The user input information may include mode selection information, screen brightness control information, and the like.

The control signal generator 16 differently generates a screen brightness control signal CMD depending on a driving mode. The control signal generator 16 may select one of a normal mode, a visibility improvement mode, and a mura prevention mode, which are previously set based on the user input information from the system 20 corresponding to inputted the selection information from the user, as the driving mode. The visibility improvement mode may implement a screen output that is brighter than the normal mode, and the mura prevention mode may implement a screen output that is darker than the normal mode. The control signal generator 16 converts a quantity of external light input from the illuminance sensor 30 into digital illuminance information (hereinafter, referred to as "ALS") through an analog-to-digital converter (ADC). The control signal generator 16 may update information, which is previously stored in an ALS register using the digital illuminance information ALS. The control signal generator 16 may be embedded in the system 20 or the timing controller 11. A function and an operation of the control signal generator 16 are described in detail with reference to FIGS. 9 to 11.

The register adjusting unit 17 independently adjusts a reference voltage register value and a gamma register value at each of the R, G, and B colors in response to the screen brightness control signal CMD from the control signal generator 16. The register adjusting unit 17 further increases the gamma register value and further decreases the reference voltage register value in the visibility improvement mode, compared to the normal mode. The register adjusting unit 17 further decreases the gamma register value and further increases the reference voltage register value in the mura (or stain) prevention mode, compared to the normal mode.

The reference voltage generator 18 generates a reference voltage at each of the R, G, and B colors based on the reference voltage register value from the register adjusting unit 17. As shown in FIG. 2, the reference voltage generator 18 may be embedded in the data driver 12, but is not limited thereto. The reference voltage generator 18 may be installed separately from the data driver 12.

The data voltage generator 19 is embedded in the data driver 12. The data voltage generator 19 generates a gamma compensation voltage corresponding to each gray level in reference to gamma reference voltages determined depending on the gamma register value from the register adjusting unit 17. The data voltage generator 19 maps the gamma compensation voltages to the digital video data DATA and converts the digital video data DATA into the data voltage.

In the OLED display according to the embodiment of the invention, a driving current flowing in each pixel PXL when an image is implemented is expressed by the following Equation "$A(Vdata-Vref)^2$, where A is a proportional constant determined depending on an electron mobility, a parasitic capacitance, a channel capacity, etc. of the driving TFT DT, Vdata is the data voltage, and Vref is the reference voltage. A luminance implemented through the pixel PXL is proportional to an amount of the driving current. Therefore, the embodiment of the invention not only increases the data voltage Vdata, but also at the same time decreases the reference voltage Vref, so as to implement a high luminance at the visibility improvement mode. Hence, outdoor visibility may be efficiently improved without changing a gamma structure (namely, without unnecessarily greatly increasing a gamma power voltage). A contrast ratio in the outdoors having a relatively high periphery brightness is totally dependent on a white luminance and a surface reflectance of the display panel. Thus, a reduction in the reference voltage Vref hardly increases a black luminance and greatly increases the white luminance, thereby improving the contrast ratio.

Further, the embodiment of the invention increases the reference voltage Vref at the mura prevention mode for driving in a low luminance and reduces a decrease adjustment width of the data voltage Vdata for implementing the low luminance, thereby minimizing mura visibility at the low luminance. Furthermore, the embodiment of the invention individually adjusts not only the data voltage Vdata but also the reference voltage Vref at each of the R, G, and B colors, so as to change the luminance depending on the conversion of the driving mode. Therefore, the embodiment of the invention can efficiently prevent or minimize the white balance or color coordinates from being distorted when the luminance changes.

Figure 3:
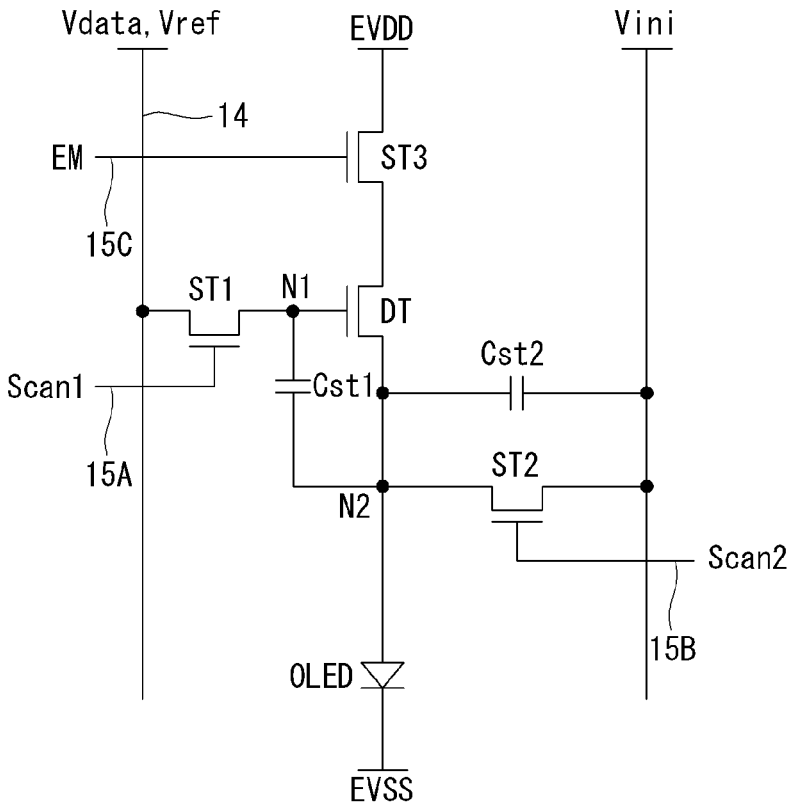
FIG. 3 shows an example of a circuit of a pixel, to which an embodiment of the invention is applied.
Figure 4:
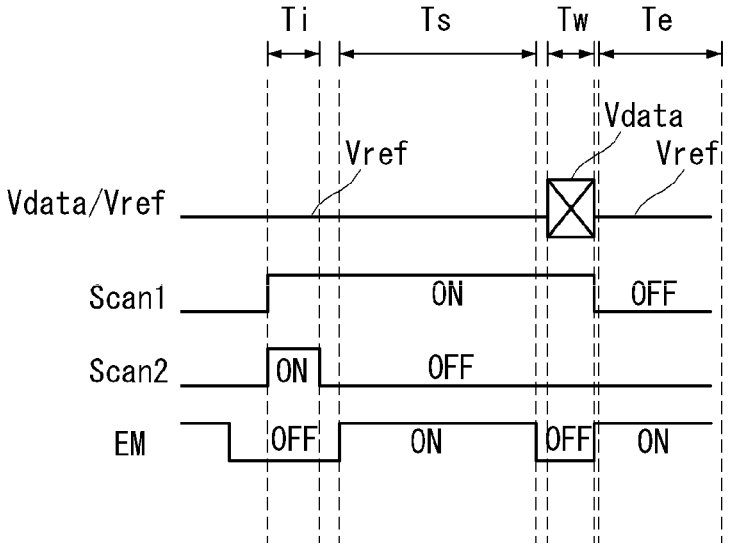
FIG. 4 is a waveform diagram showing an operation of a pixel shown in FIG. 3.

FIG. 3 shows an example of a circuit of the pixel, to which the embodiment of the invention is applied. FIG. 4 is a waveform diagram showing an operation of the pixel shown in FIG. 3. FIGS. 5A to 5D respectively show equivalent circuit diagrams of a pixel in an initialization period, a sampling period, a data application period, and an emission period.

As shown in FIGS. 3 and 4, each pixel PXL includes an OLED, a driving TFT DT, first to third switching TFTs ST1 to ST3, and first and second capacitors Cst1 and Cst2. The pixel PXL has 4T2C circuit structure including four N-channel MOSFET (NMOS) transistors and two capacitors. The 4T2C circuit structure of the pixel described in the embodiment of the invention is merely an example. Other circuit structures may be used for the pixel according to the embodiment of the invention. Therefore, the embodiment of the invention is not limited thereto.

One frame period of the pixel PXL is divided into an initialization period Ti, a sampling period Ts, a data application period Tw, and an emission period Te.

A first scan signal Scan1 is generated at an On-level during the initialization period Ti, the sampling period Ts, and the data application period Tw and turns on the first switching TFT ST1. The first scan signal Scan1 is inverted to an Off-level during the emission period Te and turns off the first switching TFT ST1.

A second scan signal Scan2 is generated at an On-level during the initialization period Ti and turns on the second switching TFT ST2. The second scan signal Scan2 is maintained at an Off-level during the sampling period Ts, the data application period Tw, and the emission period Te and controls the second switching TFT ST2 in an Off-state.

An emission signal EM is generated at an On-level during the sampling period Ts and turns on the third switching TFT ST3. The emission signal EM is inverted to an Off-level during the initialization period Ti and the data application period Tw and turns off the third switching TFT ST3. The emission signal EM is maintained at an On-level during the emission period Te and maintains the third switching TFT ST3 in an On-state.

The OLED emits light using a driving current supplied from the driving TFT DT. The OLED includes an anode, a cathode, and an organic compound layer formed between the anode and the cathode. The organic compound layer may include a hole injection layer HIL, a hole transport layer HTL, an emission layer EML, an electron transport layer ETL, and an electron injection layer EIL, but is not limited thereto. The anode of the OLED is connected to a second node N2, and the cathode of the OLED is connected to the low potential power voltage EVSS.

The first switching TFT ST1 is turned on or off in response to the first scan signal Scan1 and turns on or off (i.e., connects or disconnects) a current path between the data line 14 and a first node N1. A gate of the first switching TFT ST1 is connected to a first scan line 15A, and a drain of the first switching TFT ST1 is connected to the data line 14. A source of the first switching TFT ST1 is connected to the first node N1.

The second switching TFT ST2 is turned on or off in response to the second scan signal Scan2 and turns on or off a current path between an input terminal of an initialization voltage Vini and the second node N2. A gate of the second switching TFT ST2 is connected to a second scan line 15B, and a drain of the second switching TFT ST2 is connected to the second node N2. A source of the second switching TFT ST2 is connected to the input terminal of the initialization voltage Vini.

The third switching TFT ST3 is turned on or off in response to the emission EM and turns on or off a current path between an input terminal of the high potential power voltage EVDD and a drain of the driving TFT DT. A gate of the third switching TFT ST3 is connected to an emission line 15C, and a drain of the third switching TFT ST3 is connected to the input terminal of the high potential power voltage EVDD. A source of the third switching TFT ST3 is connected to the drain of the driving TFT DT.

The driving TFT DT controls the driving current flowing in the OLED depending on a gate-to-source voltage of the driving TFT DT. A gate of the driving TFT DT is connected to the first node N1, and the drain of the driving TFT DT is connected to the source of the third switching TFT ST3. A source of the driving TFT DT is connected to the anode of the OLED through the second node N2.

The first capacitor Cst1 is connected between the first node N1 and the second node N2 and stores a differential voltage between the first node N1 and the second node N2. The first capacitor Cst1 samples a threshold voltage Vth of the driving TFT DT in a source-follower manner. The second capacitor Cst2 is connected between the input terminal of the initialization voltage Vini and the second node N2. When a voltage of the first node N1 changes depending on the data voltage Vdata in the data application period Tw, the first and second capacitors Cst1 and Cst2 divide a voltage change amount of the first node N1 and reflect it in the second node N2.

The operation of the pixel PXL is described below.

Figure 5A:
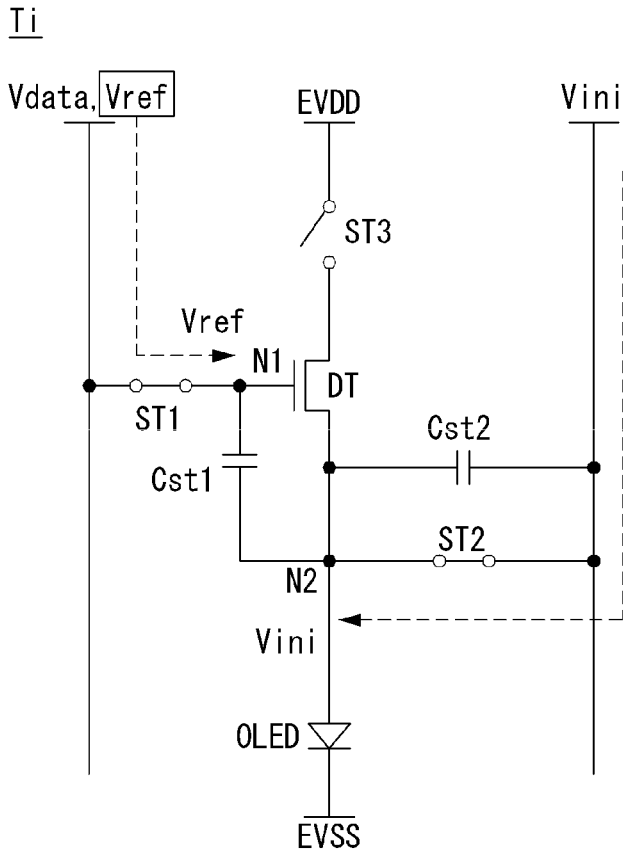
FIGS. 5A to 5D respectively show equivalent circuit diagrams of a pixel in an initialization period, a sampling period, a data application period, and an emission period according to an embodiment of the invention.

Referring to FIG. 5A, during the initialization period Ti, the first and second switching TFTs ST1 and ST2 are turned on in response to the first and second scan signals Scant and Scan2 of the On-level. During the initialization period Ti, the third switching TFT ST3 is turned off in response to the emission signal EM of the Off-level. During the initialization period Ti, the predetermined reference voltage Vref is supplied to the data line 14. During the initialization period Ti, the voltage of the first node N1 is initialized to the reference voltage Vref, and the voltage of the second node N2 is initialized to the predetermined initialization voltage Vini.

Figure 5B:
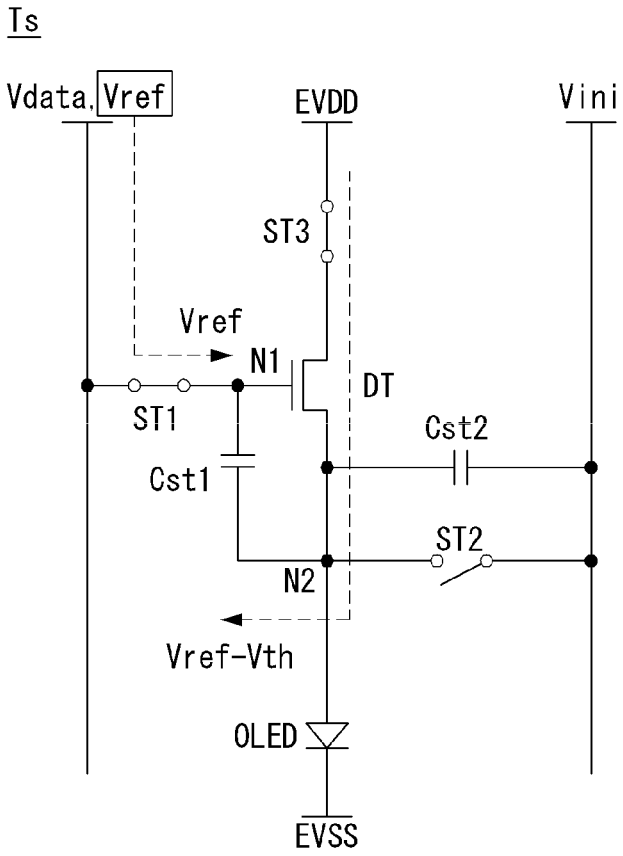

Referring to FIG. 5B, during the sampling period Ts, the third switching TFT ST3 is turned on in response to the emission signal EM of the On-level. During the sampling period Ts, the first switching TFT ST1 maintains an On-state due to the first scan signal Scan1 of the On-level, but the second switching TFT ST2 is turned off by the second scan signal Scan2 of the Off-level. During the sampling period Ts, the reference voltage Vref is supplied to the data line 14. During the sampling period Ts, the voltage of the first node N1 is maintained at the reference voltage Vref, and the voltage of the second node N2 increases due to a drain-to-source current Ids of the driving TFT DT. A gate-to-source voltage Vgs of the driving TFT DT is sampled as the threshold voltage Vth of the driving TFT DT in accordance with the source-follower manner, and the sampled threshold voltage Vth is stored in the first capacitor Cst1. During the sampling period Ts, the voltage of the first node N1 is the reference voltage Vref, and the voltage of the second node N2 is "Vref−Vth".

Figure 5C:
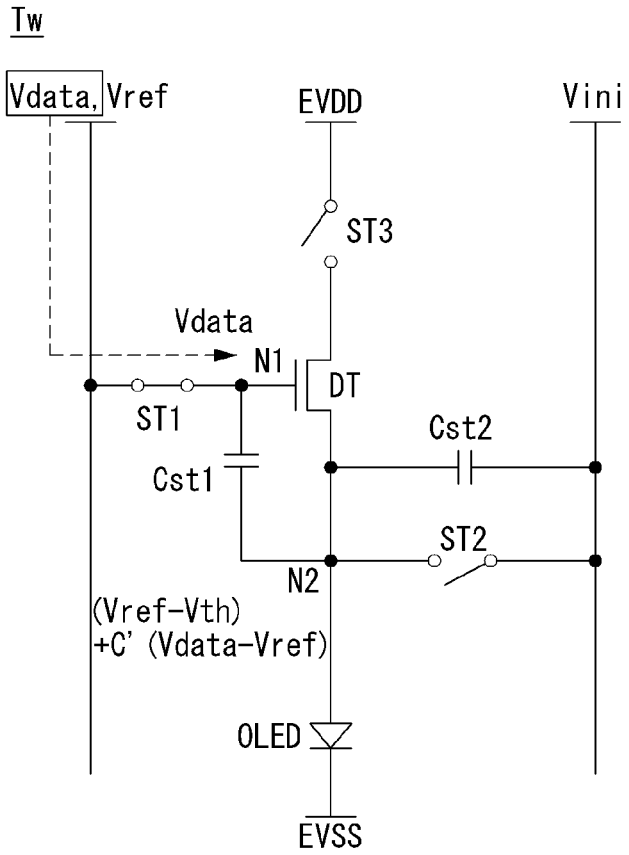

Referring to FIG. 5C, during the data application period Tw, the first switching TFT ST1 maintains the On-state in response to the first scan signal Scan1 of the On-level, and the second and third switching TFTs ST2 and ST3 and the driving TFT DT are turned off. During the data application period Tw, the data voltage Vdata of an input image is supplied to the data line 14. The data voltage Vdata is applied to the first node N1, and a voltage division result of a voltage change amount (Vdata−Vref) of the first node N1 divided into the first and second capacitors Cst1 and Cst2 is reflected in the second node N2. Hence, the gate-to-source voltage Vgs of the driving TFT DT is programmed. Specifically, during the data application period Tw, the voltage of the first node N1 is the data voltage Vdata, and the voltage of the second node N2 is "Vref−Vth+C'*(Vdata−Vref)" obtained by adding the voltage division result (C'*(Vdata−Vref)) between the first and second capacitors Cst1 and Cst2 to the voltage (Vref−Vth) set through the sampling period Ts. As a result, the gate-to-source voltage Vgs of the driving TFT DT is programmed to "Vdata−Vref+Vth−C'*(Vdata−Vref)" through the data application period Tw, where C' is "CST1/(CST1+CST2)", CST1 is a first capacitance of the first capacitor Cst1, and CST2 is a second capacitance of the second capacitor Cst2.

Figure 5D:
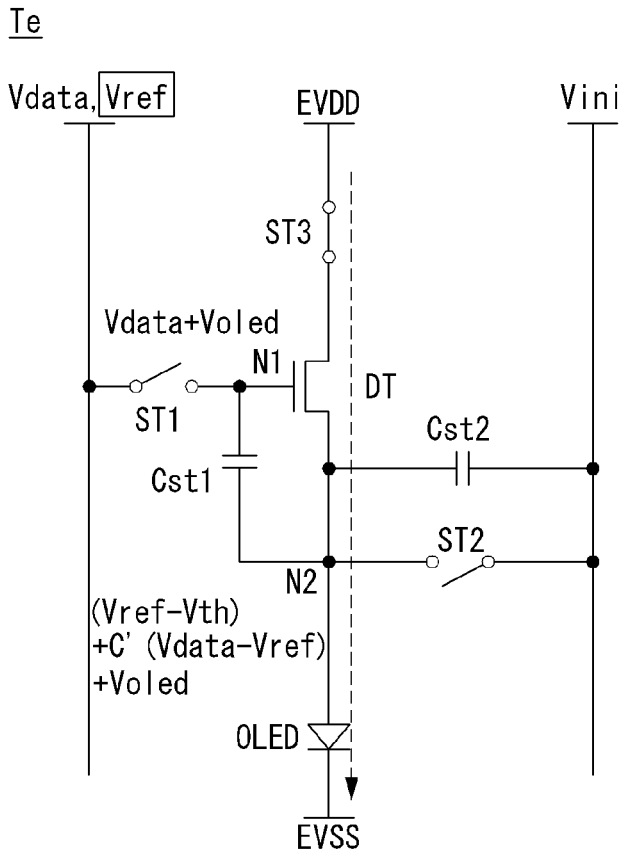

Referring to FIG. 5D, the emission period Te has a duration from an end time point of the data application period Tw of a $m_{th}$ (m is positive integer) frame to a start time point of an initialization period Ti of a next frame, i.e., $m+1_{th}$ frame. The emission signal EM is input at the On-level and turns on the third switching TFT ST3. During the emission period Te, a driving current Ioled depending on the gate-to-source voltage Vgs programmed through the data application period Tw is applied to the OLED and causes the OLED to emit light. During the emission period Te, the first and second scan signals Scan1 and Scan2 are input at the Off-level and turns off the first and second switching TFTs ST1 and ST2.

The driving current Ioled flowing in the OLED during the emission period Te is expressed by the following Equation 1. The OLED emits light due o the driving current Ioled and represents a brightness of the input image.

$$Ioled = \frac{k}{2}[(1 - C')(Vdata - Vref)]^2 \quad \text{[Equation 1]}$$

In the above Equation 1, k is a proportional constant determined depending on an electron mobility, a parasitic capacitance, a channel capacity, etc. of the driving TFT DT.

An equation related to the driving current Ioled is "k/2 $(Vgs-Vth)^2$", but the threshold voltage Vth is included in the gate-to-source voltage Vgs programmed through the data application period Tw. Therefore, as indicated by the above Equation 1, "Vth" in the equation related to the driving current Ioled is eliminated. Thus, an influence of changes in the threshold voltage Vth of the driving TFT DT on the driving current Ioled is removed.

Figure 6:
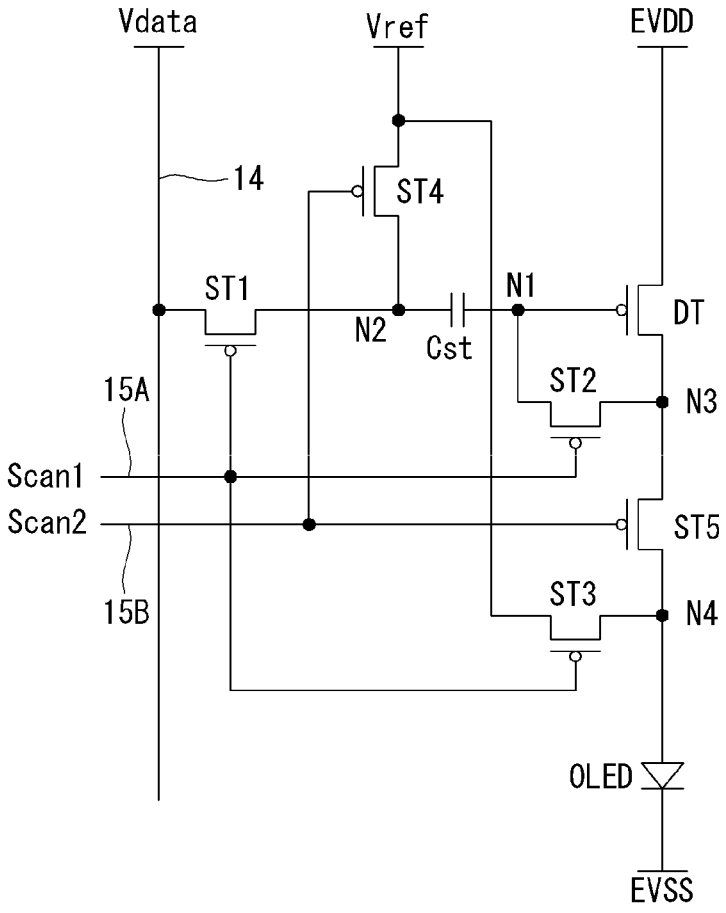
FIG. 6 shows another example of a circuit of a pixel, to which an embodiment of the invention is applied.
Figure 7:
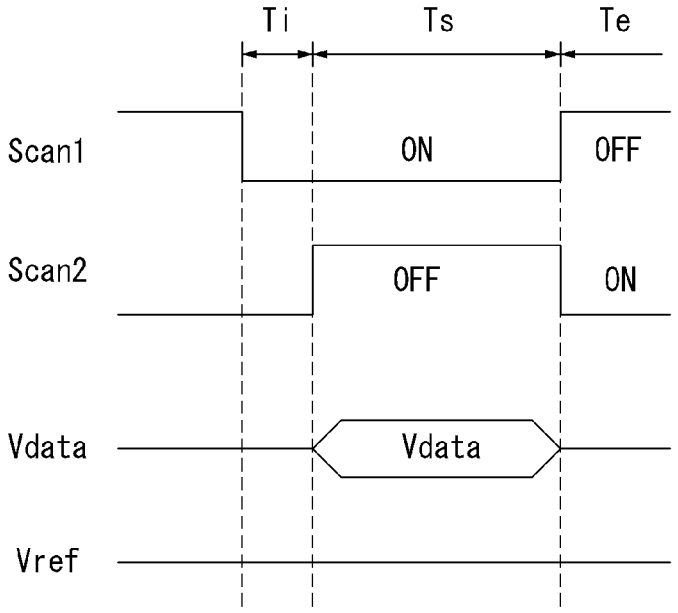
FIG. 7 is a waveform diagram showing an operation of a pixel shown in FIG. 6.
Figure 8A:
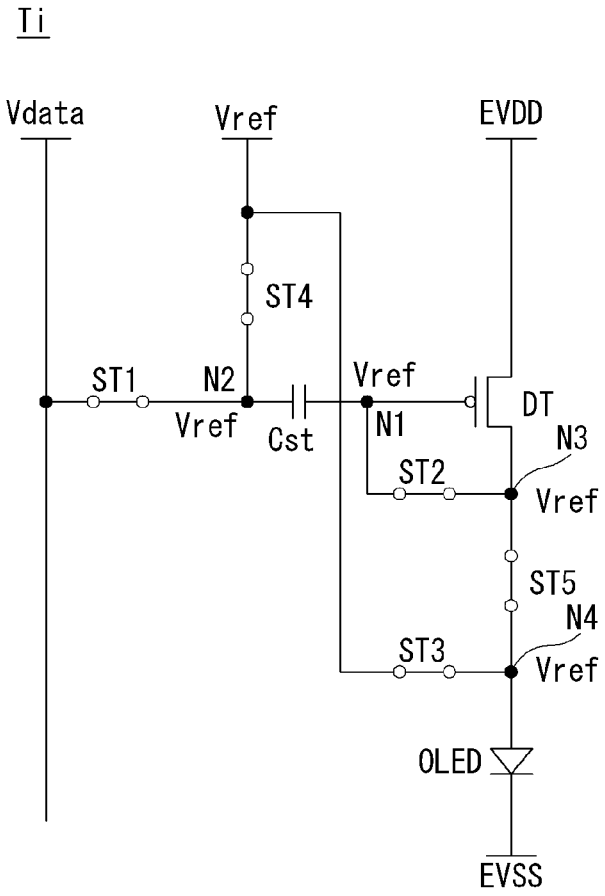
FIGS. 8A to 8C respectively show equivalent circuit diagrams of a pixel in an initialization period, a sampling period, and an emission period according to an embodiment of the invention.
Figure 8B:
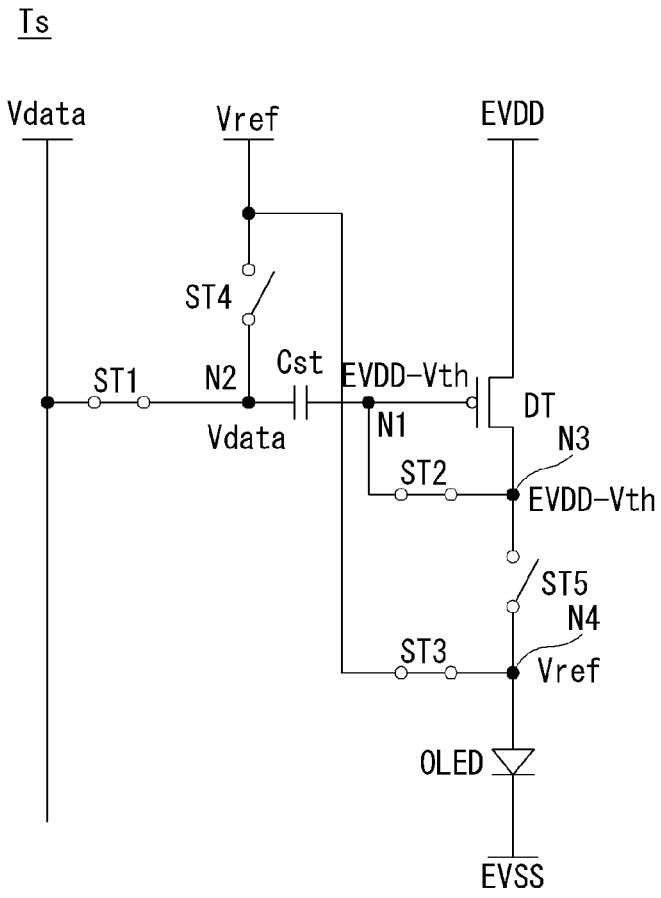
Figure 8C:
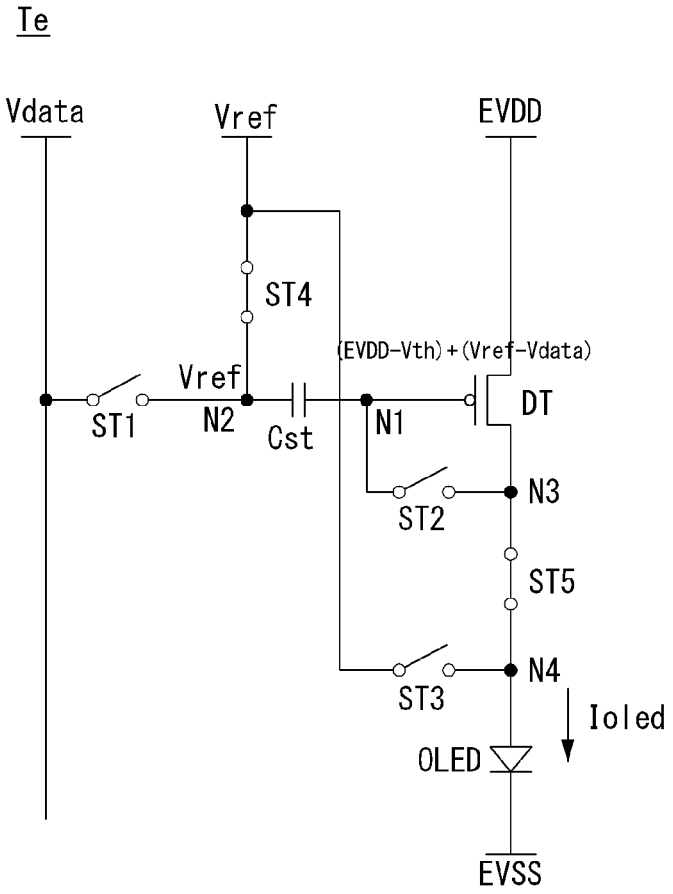

FIG. 6 shows another example of a circuit of a pixel, to which the embodiment of the invention is applied. FIG. 7 is a waveform diagram showing an operation of the pixel shown in FIG. 6. FIGS. 8A to 8C respectively show equivalent circuit diagrams of a pixel in an initialization period, a sampling period, and an emission period.

As shown in FIGS. 6 and 7, each pixel PXL includes an OLED, a driving TFT DT, first to fifth switching TFTs ST1 to ST5, and a storage capacitor Cst. The pixel PXL has 6T1C circuit structure including six P-channel MOSFET (PMOS) transistors and one capacitor. The 6T1C circuit structure of the pixel described in the embodiment of the invention is merely an example. Other circuit structures may be used for the pixel according to the embodiment of the invention. Therefore, the embodiment of the invention is not limited thereto.

One frame period of the pixel PXL is divided into an initialization period Ti, a sampling period Ts, and an emission period Te.

A first scan signal Scant is generated at an On-level during the initialization period Ti and the sampling period Ts and turns on the first switching TFT ST1. The first scan signal Scant is inverted to an Off-level during the emission period Te and turns off the first switching TFT ST1.

A second scan signal Scan2 is generated at an On-level during the initialization period Ti and the emission period Te and turns on the second switching TFT ST2. The second scan signal Scan2 is maintained at an Off-level during the sampling period Ts and controls the second switching TFT ST2 in an Off-state.

The OLED is connected between a fourth node N4 and the low potential power voltage EVSS and emits light depending on a driving current applied from the driving TFT DT.

The driving TFT DT controls the driving current flowing in the OLED depending on a gate-to-source voltage of the driving TFT DT. A gate of the driving TFT DT is connected to a first node N1, and the drain of the driving TFT DT is connected to the source of a third switching TFT ST3. A source of the driving TFT DT is connected to the input terminal of the high potential power voltage EVDD.

The first switching TFT ST1 is turned on or off in response to the first scan signal Scan1 and turns on or off a current path between the data line 14 and a second node N2. A gate of the first switching TFT ST1 is connected to a first scan line 15A, and a drain of the first switching TFT ST1 is connected to the second node N2. A source of the first switching TFT ST1 is connected to the data line 14

The second switching TFT ST2 is turned on or off in response to the first scan signal Scan1 and turns on or off a current path between the first node N1 and a third node N3. A gate of the second switching TFT ST2 is connected to the first scan line 15A, and a drain of the second switching TFT ST2 is connected to the third node N3. A source of the second switching TFT ST2 is connected to the first node N1.

The third switching TFT ST3 is turned on or off in response to the first scan signal Scan1 and turns on or off a current path between an input terminal of the reference voltage Vref and the fourth node N4. A gate of the third switching TFT ST3 is connected to the first scan line 15A, and a drain of the third switching TFT ST3 is connected to the fourth node N4. A source of the third switching TFT ST3 is connected to the input terminal of the reference voltage Vref.

The fourth switching TFT ST4 is turned on or off in response to the second scan signal Scan2 and turns on or off a current path between the input terminal of the reference voltage Vref and the second node N2. A gate of the fourth switching TFT ST4 is connected to a second scan line 15B, and a drain of the fourth switching TFT ST4 is connected to the second node N2. A source of the fourth switching TFT ST4 is connected to the input terminal of the reference voltage Vref.

The fifth switching TFT ST5 is turned on or off in response to the second scan signal Scan2 and turns on or off a current path between the third node N3 and the fourth node N4. A gate of the fifth switching TFT ST5 is connected to the second scan line 15B, and a drain of the fifth switching TFT ST5 is connected to the fourth node N4. A source of the fifth switching TFT ST5 is connected to the third node N3.

The storage capacitor Cst is connected between the first node N1 and the second node N2.

The operation of the pixel PXL is described below.

Referring to FIG. 8A, during the initialization period Ti, the first to fifth switching TFTs ST1 to ST5 are turned on in response to the first and second scan signals Scan1 and Scan2 of the On-level. During the initialization period Ti, the voltages of the first to fourth nodes N1 to N4 are initialized to the reference voltage Vref.

Referring to FIG. 8B, during the sampling period Ts, the first to third switching TFTs ST1 to ST3 maintain an On-state in response to the first scan signal Scan1 of the On-level, but the fourth and fifth switching TFTs ST4 and ST5 are turned off in response to the second scan signal Scan2 of the Off-level. During the sampling period Ts, the data voltage Vdata is applied to the second node N2 through the data line 14. During the sampling period Ts, the voltages the first and third nodes N1 and N3 are "EVDD−Vth", where Vth is a threshold voltage of the driving TFT DT.

Referring to FIG. 8C, the emission period Te has a duration from an end time point of the sampling period Ts of a $n_{th}$ (n is positive integer) frame to a start time point of an initialization period Ti of a next frame, i.e., $n+1_{th}$ frame. During the emission period Te, the first to third switching TFTs ST1 to ST3 are turned off in response to the first scan signal Scan1 of the Off-level, and the fourth and fifth switching TFTs ST4 and ST5 are turned on in response to the second scan signal Scan2 of the On-level.

During the emission period Te, the reference voltage Vref is applied to the second node N2, and a voltage change amount (Vref−Vdata) of the second node N2 is reflected in the first node N1. During the emission period Te, the voltage of the first mode N1 is programmed to "(EVDD−Vth)+(Vref−Vdata)". Thus, during the emission period Te, a gate-to-source voltage Vgs of the driving TFT DT is programmed to "Vdata−Vref+Vth".

A driving current Ioled flowing in the OLED during the emission period Te is expressed by the following Equation 2. The OLED emits light due o the driving current Ioled and represents a brightness of the input image.

$$Ioled = \frac{k}{2}[(Vdata - Vref)]^2 \quad \text{[Equation 2]}$$

In the above Equation 2, k is a proportional constant determined depending on an electron mobility, a parasitic capacitance, a channel capacity, etc. of the driving TFT DT.

An equation related to the driving current Ioled is "$k/2(Vgs-Vth)^2$", but the threshold voltage Vth is included in the gate-to-source voltage Vgs programmed through the emission period Te. Therefore, as indicated by the above Equation 2, "Vth" in the equation related to the driving current Ioled is eliminated. Thus, an influence of changes in the threshold voltage Vth of the driving TFT DT on the driving current Ioled is removed.

Figures 9, 10:
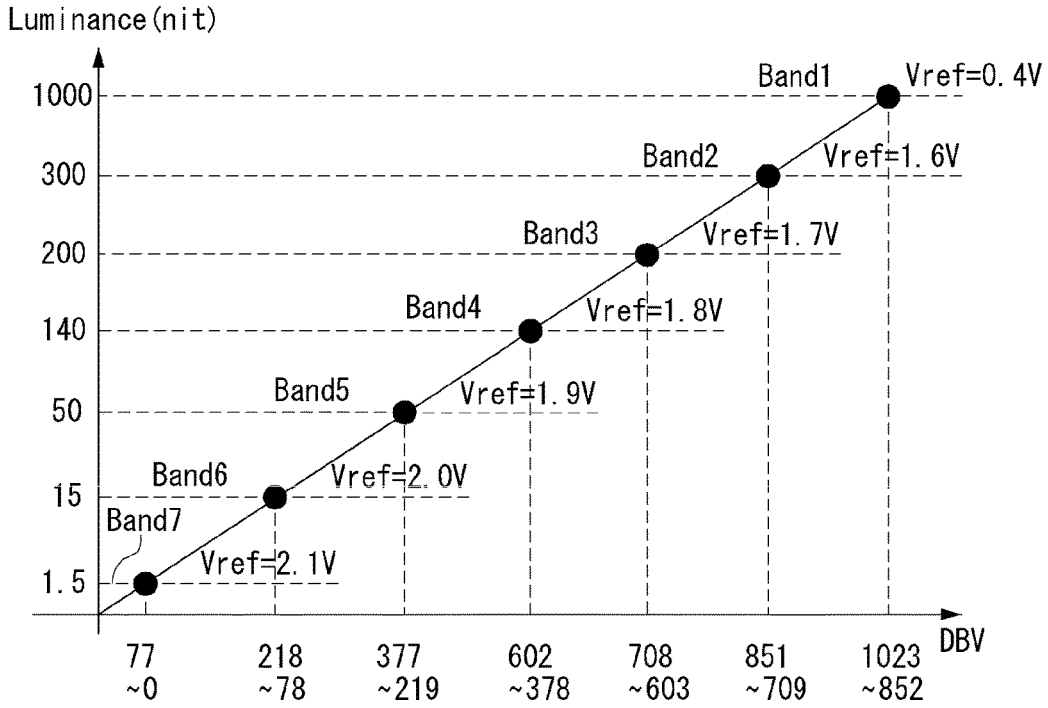
FIG. 9 shows reference voltage setting values of each band, which are previously set through an optical compensation process according to an embodiment of the invention.
FIG. 10 shows an example of bands, each of which corresponds to some of digital brightness values and is used as a reference of the optical compensation according to an embodiment of the invention.
Figure 11:
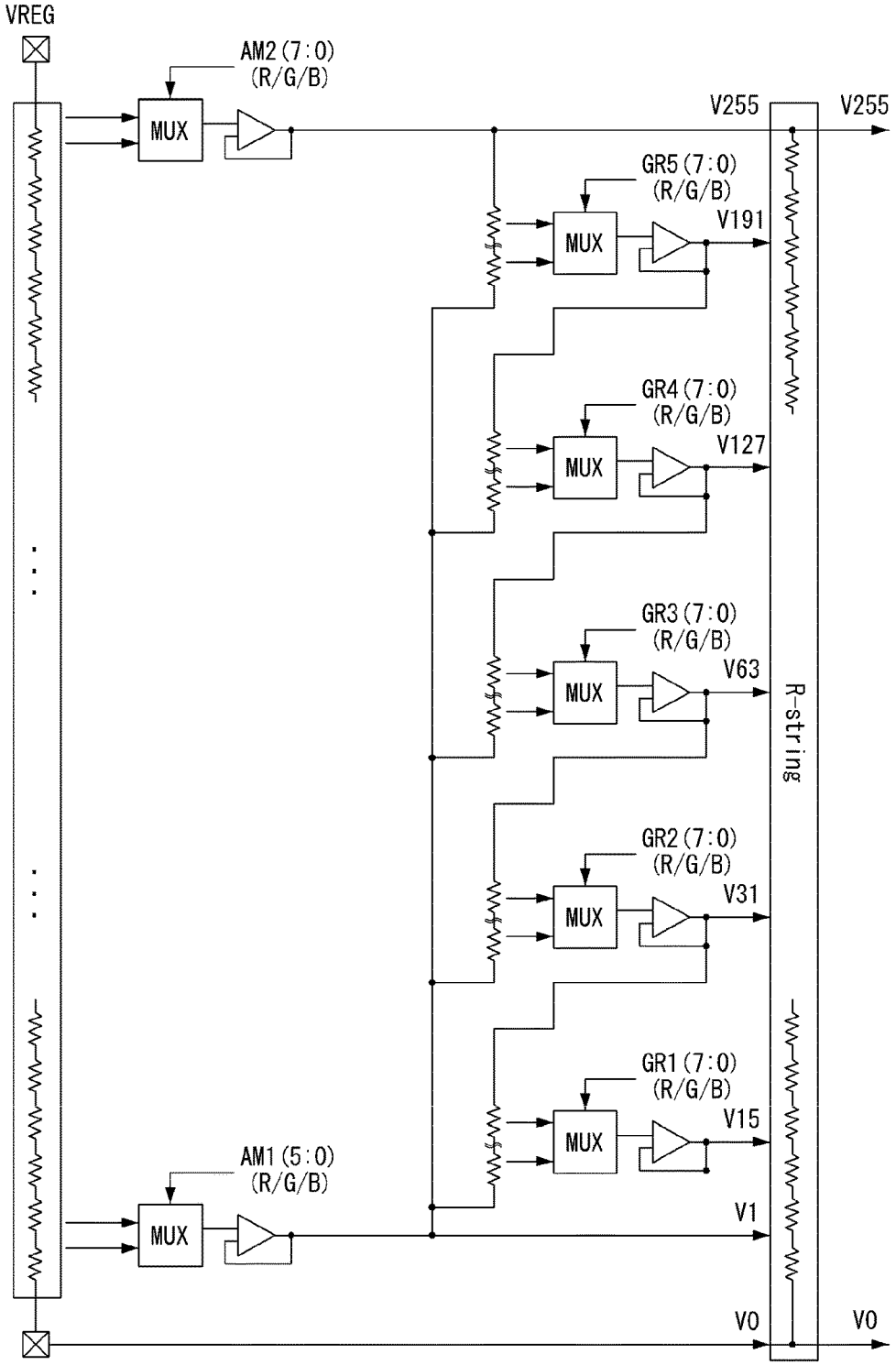
FIG. 11 shows one configuration of a gamma reference voltage generator receiving gamma register values which are individually set at R, G, and B colors of each band.

FIG. 9 shows reference voltage setting values of each band, which are previously set through an optical compensation process. FIG. 10 shows an example of bands, each of which corresponds to some of digital brightness values and is used as a reference of the optical compensation. FIG. 11 shows one configuration of a gamma reference voltage generator receiving gamma register values which are individually set at the R, G, and B colors in each band.

A user may scroll a brightness control bar configured on the touch display screen using his or her finger, etc., so as to change the screen brightness. In this instance, the system may select a proper digital brightness value DBV (hereinafter, referred to as "DBV") depending on a movement degree of the brightness control bar and may recognize the selected digital brightness value DBV as user input information. As shown in FIG. 10, if the digital brightness value DBV is of 1024 steps, the screen brightness may be controlled as many as the 1024 steps.

The OLED display according to the embodiment of the invention may include a plurality of bands, so as to prevent or minimize a white balance or color coordinates from being distorted when the luminance changes depending on the user input information. In the embodiment of the invention, as shown in FIG. 10, the plurality of bands respectively correspond to some (77, 218, 377, 602, 708, 851, and 1023) of the digital brightness values DBV input from the user and are defined as an optical compensation point, in which the optical compensation is previously set on gamma register values and reference voltage register values. As shown in FIG. 10, the bands may be set to seven bands Band1 to Band7. The number of bands may vary depending on a model and a specification of the display device.

At each of the R, G, and B colors, each of the bands Band1 to Band7 has the gamma resister values and the reference voltage register values considering the optical compensation.

As shown in FIG. 11, the gamma reference voltage generator has predetermined gamma reference voltage tabs V1, V15, V31, V63, V127, V191, and V255 outputting gamma reference voltages depending on gamma resister values AM1, GR1, GR2, GR3, GR4, GR5, and AM2. Magnitudes of the gamma reference voltages output through the gamma reference voltage tabs V1, V15, V31, V63, V127, V191, and V255 are determined by the gamma resister values AM1, GR1, GR2, GR3, GR4, GR5, and AM2. At each of the R, G, and B colors, each of the bands Band1 to Band7 independently has the gamma resister values AM1, GR1, GR2, GR3, GR4, GR5, and AM2. Thus, the gamma register value corresponding to the same tab may be differently set in the bands and also may be differently set in the R, G, and B colors.

The mapped digital brightness value DBV gradually decreases as it goes from the first band Band1 to the seventh band Band7. Therefore, the gamma resister values AM1, GR1, GR2, GR3, GR4, GR5, and AM2 are set to gradually decreasing values as it goes from the first band Band1 to the seventh band Band7. Thus, the gamma reference voltage output through the same tab may gradually decrease as it goes from the first band Band1 to the seventh band Band7.

The optical compensation of each and every one of the digital brightness values DBV individually is inefficient in terms of time and cost. The OLED display according to the embodiment of the invention may calculate the gamma register values and the reference voltage register values of adjustment sections between the adjacent bands Band1 to Band7 using predetermined or designed or set optical compensation information of the bands Band1 to Band7. More specifically, the embodiment of the invention may generate the gamma register values and the reference voltage register values of the corresponding adjustment section through a method for linearly interpolating the optical compensation information of the adjacent bands.

The control signal generator 16 according to the embodiment of the invention loads the gamma register values and the reference voltage register values of each band, which are previously set through the optical compensation process, from a memory when the driving power is turned on. FIG. 9 shows the reference voltage setting values of each band (Band1 to Band7) corresponding to the reference voltage register values. The embodiment of the invention uses the method for increasing the data voltage and at the same time reducing the reference voltage for the pixels, to which the equation "$Ioled=k(Vdata-Vref)^2$" is applied, thereby greatly reducing an output swing width and the power consumption of the data voltage, compared to the related art which has to excessively increase the data voltage so as to implement the high luminance.

Further, the embodiment of the invention may represent the low gray level using the relatively high data voltage by using a method for increasing the reference voltage in the low luminance mode for the mura prevention. Further, in some embodiments, the reference voltage can be increased so that the low gray level can be represented even when high data voltage is used. In other words, a mura phenomenon at the low gray level is prevented or minimized through lowering the difference between the reference voltage and the data voltage by applying high voltage value to not only the reference voltage but also the data voltage. In other words, both the reference voltage and the data voltage are adjusted to minimize the difference between the reference voltage and the data voltage, thereby suppressing the mura phenomenon. In general, there is an output characteristic deviation between source amplifiers of the data driver 12, and the output characteristic deviation increases as the data voltage output through the source amplifiers decreases. Because the embodiment of the invention uses the method for increasing the reference voltage in the low luminance mode (i.e., the mura prevention mode), the embodiment of the invention can implement the same low luminance as the related art using the data voltage greater than the related art. Hence, due to minimize the output characteristic deviation between source amplifiers, it is efficient to prevent or minimize vertical line mura phenomenon of the screen.

As shown in FIG. 9, the reference voltage Vref of each of the bands Band1 to Band7 is previously set through the optical compensation, and each of reference voltages Vref between the adjacent bands has to be properly selected depending on changes in the digital brightness value DBV. For this, the embodiment of the invention may divide the reference voltages of the adjacent bands into the voltage steps depending on the DBV and may linearly interpolate the voltage steps. For example, as shown in FIG. 9, if the reference voltage Vref of the R pixel (hereinafter, referred to as "R reference voltage Vref") of the first band Band1 is 0.4V, the R reference voltage Vref of the second band Band2 is 1.6V, the DBV of the first band Band1 is 1023, and the DBV of the second band Band2 is 851, the DBV may be 172 steps (=1023−851). Thus, the embodiment of the invention may divide a change amount '1.2V' of the reference voltage Vref of the R pixel into 172 steps and may change the reference voltage Vref of the R pixel by '6.97 mV (=1.2V/172)' each time the DBV changes by "1". The embodiment of the invention linearly interpolates the reference voltage Vref through such a method and thus can prevent or minimize the white balance and the color coordinates from being distorted when the luminance changes. Furthermore, the embodiment of the invention may more smoothly implement the luminance variation.

The control signal generator 16 according to the embodiment of the invention loads the plurality of bands, on which the optical compensation is previously performed, and then selects one of the normal mode, the visibility improvement mode (i.e., the high luminance mode), and the mura prevention mode (i.e., the low luminance mode) which are previously set, as the driving mode. In the normal mode, the band (for example, the second band Band2) representing the second highest luminance among the bands Band1 to Band7 may be selected as a default band. If there is no user input information, the control signal generator 16 may select the normal mode as the driving mode and output a screen brightness control signal corresponding to the default band Band2.

The visibility improvement mode may be directly selected by the user. For example, the user can directly select the visibility improvement mode as the driving mode of the screen when the user thinks that the brightness of the screen needs to be increased where the surrounding of the screen is bright. When the visibility improvement mode is directly selected by the user, the control signal generator 16 may select a first target adjustment section from the default band Band2 to the uppermost band Band1 representing the highest luminance so as to increase the screen brightness. The control signal generator 16 may sense a quantity of external light and update the digital illuminance information ALS, so that the screen brightness is adjusted depending on the brightness of peripheral light. The control signal generator 16 may output the updated digital illuminance information ALS as the screen brightness control signal. The register adjusting unit 17 may increase the gamma register values of each of the R, G, and B colors from a gamma default value of the default band Band2 based on the digital illuminance information ALS from the control signal generator 16 and may decrease the reference voltage register values of each of the R, G, and B colors from a reference voltage default value of the default band Band2 based on the digital illuminance information ALS. The register adjusting unit 17 may readout the corresponding gamma register values of each of the R, G, and B colors from a first lookup table using the digital illuminance information ALS as a read address and may readout the corresponding reference voltage register values of each of the R, G, and B colors from a second lookup table using the digital illuminance information ALS as a read address.

Instead of the visibility improvement mode being directly selected by the user, the control signal generator 16 may select the visibility improvement mode as the driving mode. For example, the user directly control only the brightness of the screen without direct selection of the visibility improvement mode as the driving mode of the screen, or the brightness of the screen is automatically increased without the direct control by the user through the screen sensing the brightness of the surroundings. When the digital brightness value DBV increases from a DBV default value of the default band Band2 by the screen brightness control of the user (for example, the scrolling of the brightness control bar represented on the screen by the user), the control signal generator 16 may select the visibility improvement mode as the driving mode and may select the first target adjustment section from the default band Band2 to the uppermost band Band1 representing the highest luminance. The control signal generator 16 may output a change amount (i.e., an increase amount) of the DBV as the screen brightness control signal, so that the screen brightness is adjusted depending on a change amount of the DBV. The register adjusting unit 17 may increase the gamma register value of each of the R, G, and B colors from the gamma default value of the default band Band2 and may decrease the reference voltage register value of each of the R, G, and B colors from the reference voltage default value of the default band Band2 in order that the gamma register value and the reference voltage register value correspond to the increase amount of the DBV input from the control signal generator 16. The register adjusting unit 17 may use the above-described linear interpolation method, so as to adjust the gamma register value and the reference voltage register value at each of the R, G, and B colors.

For example, the register adjusting unit 17 may divide a difference between the R reference voltages Vref belonging to the uppermost band Band1 and the default band Band2 by the increase amount of the DBV and may obtain '1 step R reference voltage adjustment amount'. The register adjusting unit 17 may gradually decrease the R reference voltage register value by the 1 step R reference voltage adjustment amount at a predetermined interval (for example, one frame). The register adjusting unit 17 may divide a difference between the G reference voltages Vref belonging to the uppermost band Band1 and the default band Band2 by the increase amount of the DBV and may obtain '1 step G reference voltage adjustment amount'. The register adjusting unit 17 may gradually decrease the G reference voltage register value by the 1 step G reference voltage adjustment amount at a predetermined interval (for example, one frame). The register adjusting unit 17 may divide a difference between the B reference voltages Vref belonging to the uppermost band Band1 and the default band Band2 by the increase amount of the DBV and may obtain '1 step B reference voltage adjustment amount'. The register adjusting unit 17 may gradually decrease the B reference voltage register value by the 1 step B reference voltage adjustment amount at a predetermined interval (for example, one frame).

Instead of the mura prevention mode being directly selected by the user, the control signal generator 16 may select the mura prevention mode as the driving mode. For example, the user directly controls only the brightness of the screen without direct selection of the mura prevention mode as the driving mode of the screen, or the brightness of the screen is automatically decreased without the direct control by the user through the screen sensing the brightness of the surroundings. When the digital brightness value DBV decreases from the DBV default value of the default band Band2 by the screen brightness control of the user (for example, the scrolling of the brightness control bar represented on the screen by the user), the control signal generator 16 may select the mura prevention mode as the driving mode and may select a second target adjustment section from the default band Band2 to a lower band (for example, Band3) representing a luminance lower than the default band Band2. The control signal generator 16 may output a change amount (i.e., decrease amount) of the DBV as the screen brightness control signal, so that the screen brightness is adjusted depending on a change amount of the DBV. The register adjusting unit 17 may decrease the gamma register value of each of the R, G, and B colors from the gamma default value of the default band Band2 and may increase the reference voltage register value of each of the R, G, and B colors from the reference voltage default value of the default band Band2, in order that the gamma register value and the reference voltage register value correspond to the decrease amount of the DBV input from the control signal generator 16. The register adjusting unit 17 may use the above-described linear interpolation method, so as to adjust the gamma register value and the reference voltage register value at each of the R, G, and B colors.

For example, the register adjusting unit 17 may divide a difference between the R reference voltages Vref belonging to the lower band Band3 and the default band Band2 by the decrease amount of the DBV and may obtain '1 step R reference voltage adjustment amount'. The register adjusting unit 17 may gradually increase the R reference voltage register value by the 1 step R reference voltage adjustment amount at a predetermined interval (for example, one frame). The register adjusting unit 17 may divide a difference between the G reference voltages Vref belonging to the lower band Band3 and the default band Band2 by the decrease amount of the DBV and may obtain '1 step G reference voltage adjustment amount'. The register adjusting unit 17 may gradually increase the G reference voltage register value by the 1 step G reference voltage adjustment amount at a predetermined interval (for example, one frame). The register adjusting unit 17 may divide a difference between the B reference voltages Vref belonging to the lower band Band3 and the default band Band2 by the decrease amount of the DBV and may obtain '1 step B reference voltage adjustment amount'. The register adjusting unit 17 may gradually increase the B reference voltage register value by the 1 step B reference voltage adjustment amount at a predetermined interval (for example, one frame).

Figure 12:
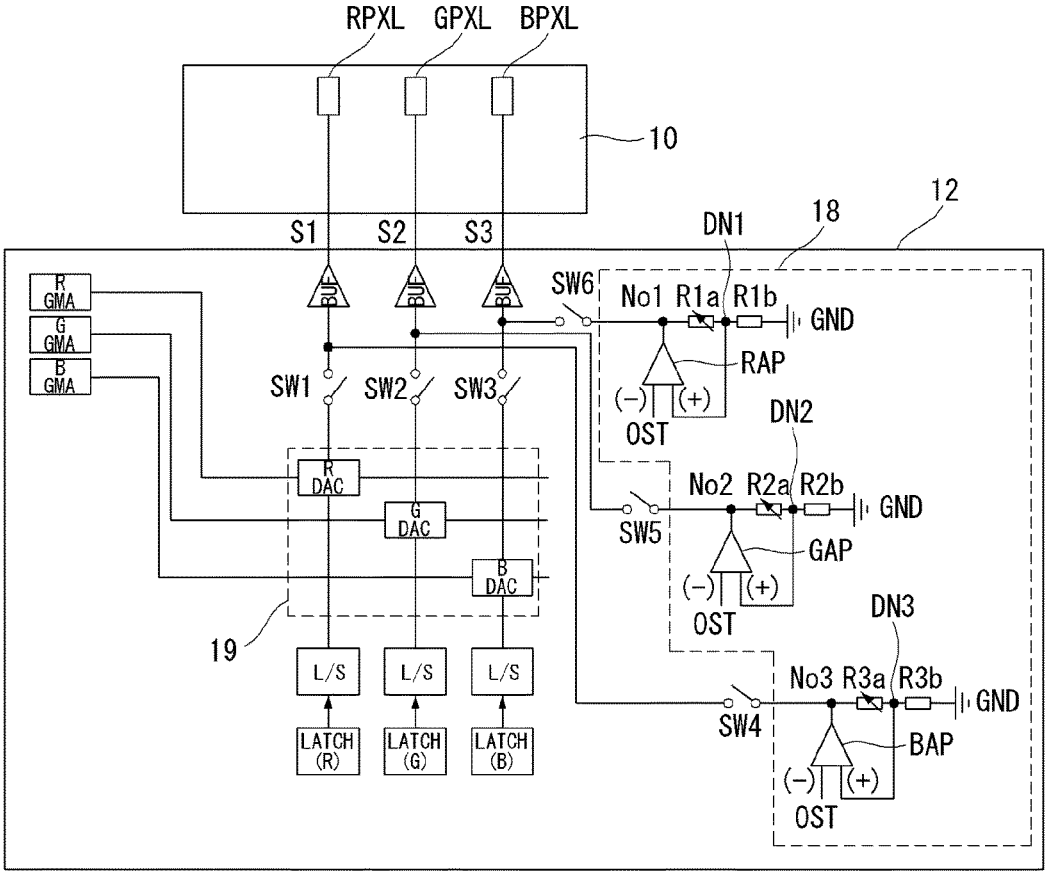
FIG. 12 shows one configuration of a data driver including a reference voltage generator according to an embodiment of the invention.
Figures 13, 14:
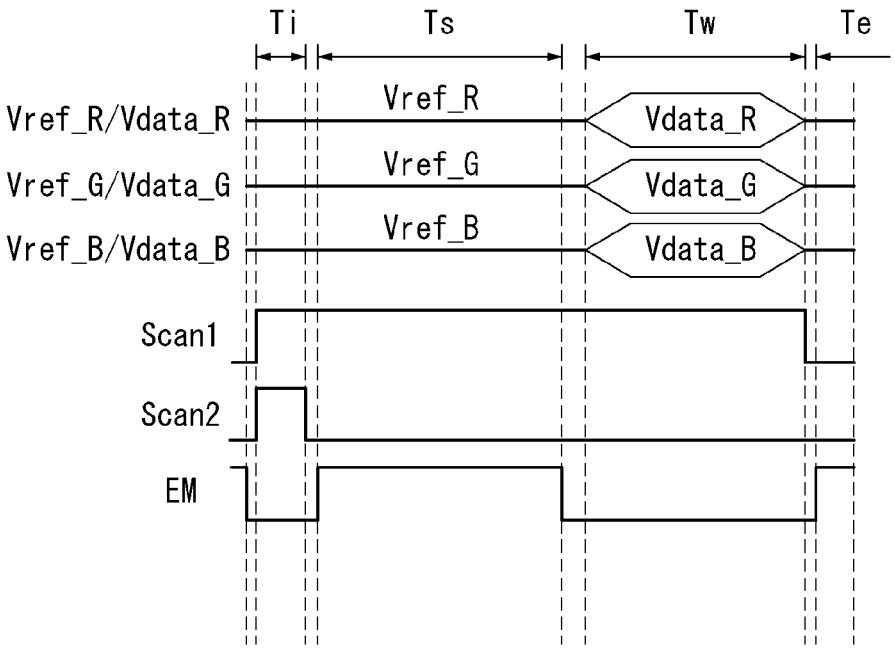
FIG. 13 shows on-timing and off-timing of switches shown in FIG. 12.
FIG. 14 shows output timing of a data voltage and a reference voltage shown in FIG. 12.

FIG. 12 shows one configuration of the data driver including the reference voltage generator according to the embodiment of the invention. FIG. 13 shows on-timing and off-timing of switches shown in FIG. 12. FIG. 14 shows output timing of the data voltage and the reference voltage shown in FIG. 12.

Referring to FIG. 12, the reference voltage generator 18 and the data voltage generator 19 according to the embodiment of the invention may be embedded in the data driver 12.

The reference voltage generator 18 includes a first reference voltage generator generating the R reference voltage Vref_R depending on the R reference voltage register value, a second reference voltage generator generating the G reference voltage Vref_G depending on the G reference voltage register value, and a third reference voltage generator generating the B reference voltage Vref_B depending on the B reference voltage register value.

The first reference voltage generator includes a first variable resistor R1*a* which is connected between a first output node No1 and a first division node DN1 and has a resistance varying depending on the R reference voltage register value (varying depending on the driving mode), a first fixed resistor R1*b* connected between the first division node DN1 and a ground level voltage source GND, and a first amplifier RAP having an inverting terminal (−), to which an offset value OST is input, a non-inverting terminal (+) connected to the first division node DN1, and an output terminal connected to the first output node No1.

The second reference voltage generator includes a second variable resistor R2*a* which is connected between a second output node No2 and a second division node DN2 and has a resistance varying depending on the G reference voltage register value (varying depending on the driving mode), a second fixed resistor R2*b* connected between the second division node DN2 and the ground level voltage source GND, and a second amplifier GAP having an inverting terminal (−), to which an offset value OST is input, a non-inverting terminal (+) connected to the second division node DN2, and an output terminal connected to the second output node No2.

The third reference voltage generator includes a third variable resistor R3*a* which is connected between a third output node No3 and a third division node DN3 and has a resistance varying depending on the B reference voltage register value (varying depending on the driving mode), a third fixed resistor R3*b* connected between the third division node DN3 and the ground level voltage source GND, and a third amplifier BAP having an inverting terminal (−), to which an offset value OST is input, a non-inverting terminal (+) connected to the third division node DN3, and an output terminal connected to the third output node No3.

The data voltage generator 19 includes an R digital-to-analog converter (DAC), a G DAC, and a B DAC.

The R DAC generates R gamma compensation voltages corresponding to each gray level based on R gamma reference voltages R GMA (having voltage levels varying depending on the driving mode) determined depending on the gamma register values at the gamma reference voltage generator shown in FIG. 11, maps the R gamma compensation voltages to R digital video data, and converts the R digital video data into the R data voltage Vdata_R. The G DAC generates G gamma compensation voltages corresponding to each gray level based on G gamma reference voltages G GMA (having voltage levels varying depending on the driving mode) determined depending on the gamma register values at the gamma reference voltage generator shown in FIG. 11, maps the G gamma compensation voltages to G digital video data, and converts the G digital video data into the G data voltage Vdata_G. The B DAC generates B gamma compensation voltages corresponding to each gray level based on B gamma reference voltages B GMA (having voltage levels varying depending on the driving mode) determined depending on the gamma register values at the gamma reference voltage generator shown in FIG. 11, maps the B gamma compensation voltages to B digital video data, and converts the B digital video data into the B data voltage Vdata_B.

Output terminals of the R DAC, the G DAC, and the B DAC are respectively connected to source amplifiers BUF through first to third switches SW1 to SW3. Output terminals of the first to third reference voltage generators are respectively connected to the source amplifiers BUF through fourth to sixth switches SW4 to SW6. The source amplifiers BUF are connected to the R, G, and B pixels RPXL, GPXL, and BPXL of the display panel 10 through first to third bus lines S1 to S3.

Referring to FIGS. 13 and 14 using the circuit configuration shown in FIGS. 3 and 4 as an example, the first to third switches SW1 to SW3 are turned on during the data application period Tw and respectively apply the R, G, and B data voltages Vdata_R, Vdata_G, and Vdata_B to the R, G, and B pixels RPXL, GPXL, and BPXL through the first to third bus lines S1 to S3. The first to third switches SW1 to SW3 are turned off during the remaining periods Ti, Ts, and Te.

As shown in FIG. 13, the fourth to sixth switches SW4 to SW6 are turned off during the data application period Tw and are turned on during the remaining periods Ti, Ts, and Te. As shown in FIG. 14, the R, G, and B reference voltages Vref_R, Vref_G, and Vref_B are simultaneously applied to the R, G, and B pixels RPXL, GPXL, and BPXL through the first to third bus lines S1 to S3 in the periods Ti and Ts, during which the fourth to sixth switches SW4 to SW6 are turned on.

Figure 15:
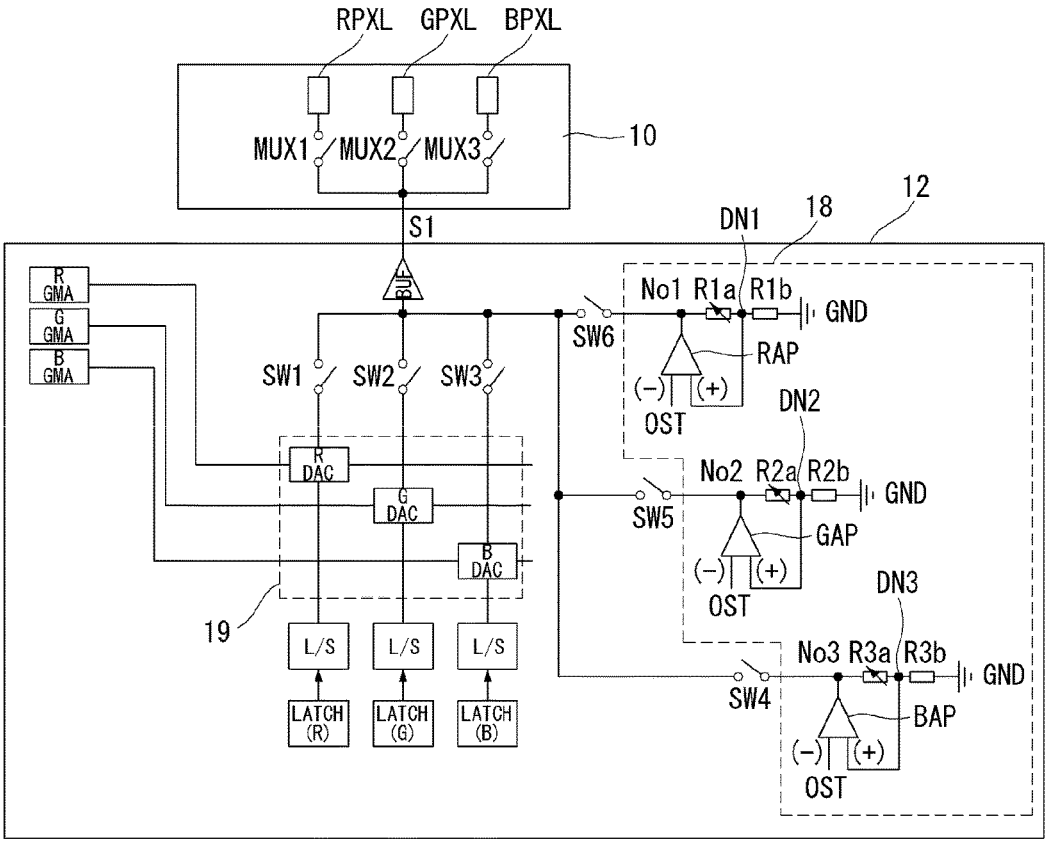
FIG. 15 shows another configuration of a data driver including a reference voltage generator according to an embodiment of the invention.
Figure 17:
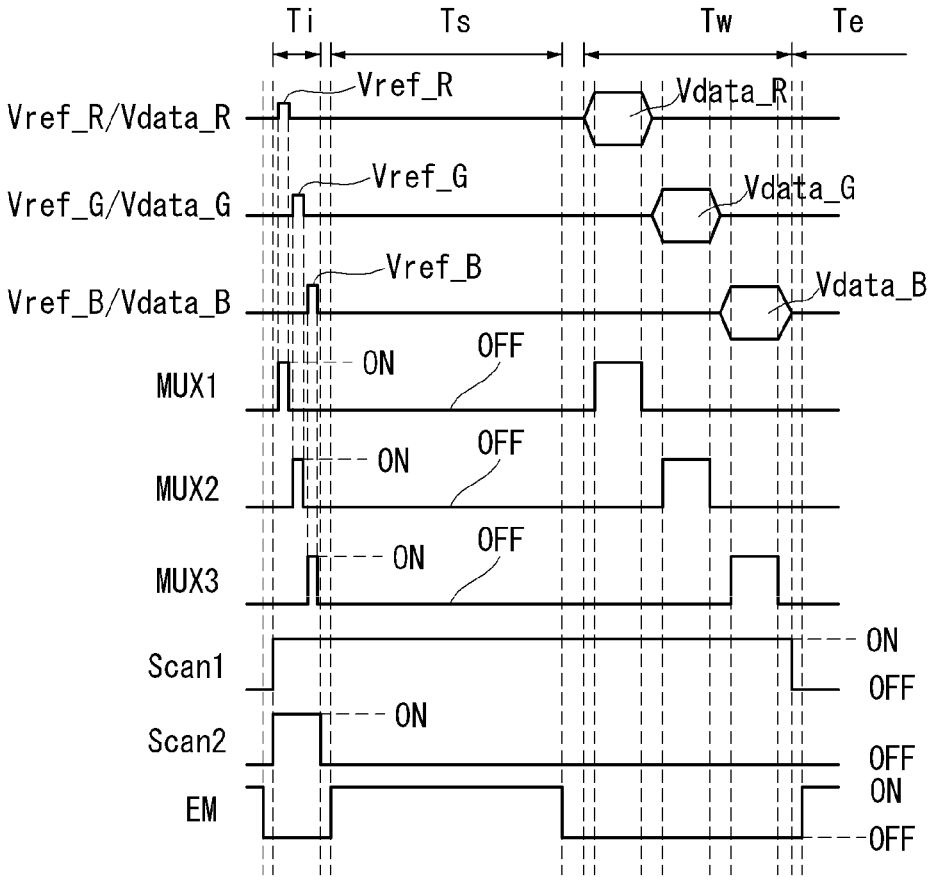
FIG. 17 shows output timing of a data voltage and a reference voltage shown in FIG. 15.

FIG. 15 shows another configuration of the data driver including the reference voltage generator. FIG. 16 shows on-timing and off-timing of switches shown in FIG. 15. FIG. 17 shows output timing of a data voltage and a reference voltage shown in FIG. 15.

Referring to FIG. 15, the reference voltage generator 18 and the data voltage generator 19 according to the embodiment of the invention may be embedded in the data driver 12.

The detailed configuration of the reference voltage generator 18 and the data voltage generator 19 is substantially the same as FIG. 12, and thus a description may be briefly made or may be entirely omitted.

The display panel 10 shown in FIG. 15 further includes multiplexers MUX1 to MUX3 which time-divide an output from one bus line S1 and distribute the output to the R, G, and B pixels RPXL, GPXL, and BPXL. The multiplexers MUX1 to MUX3 reduce the number of bus lines to ⅓ of that in FIG. 12 and also reduce the number of output channels of the data driver 12 to ⅓ of that in FIG. 12. A reduction in the number of output channels of the data driver 12 has advantages of a reduction in the size and the manufacturing cost of the data driver 12.

Referring to FIGS. 16 and 17 using the circuit configuration shown in FIGS. 3 and 4 as an example, first to third switches SW1 to SW3 and the multiplexers MUX1 to MUX3 are sequentially turned on during the data application period Tw and sequentially apply the R, G, and B data voltages Vdata_R, Vdata_G, and Vdata_B to the R, G, and B pixels RPXL, GPXL, and BPXL through the common bus line S1. The first to third switches SW1 to SW3 are turned off during the remaining periods Ti, Ts, and Te.

As shown in FIG. 16, fourth to sixth switches SW4 to SW6 and the multiplexers MUX1 to MUX3 are sequentially turned on during the initialization period Ti and sequentially apply the R, G, and B reference voltages Vref_R, Vref_G, and Vref_B to the R, G, and B pixels RPXL, GPXL, and BPXL through the common bus line S1. The fourth to sixth switches SW4 to SW6 are turned off during the remaining periods Ts, Tw, and Te.

Figure 18:
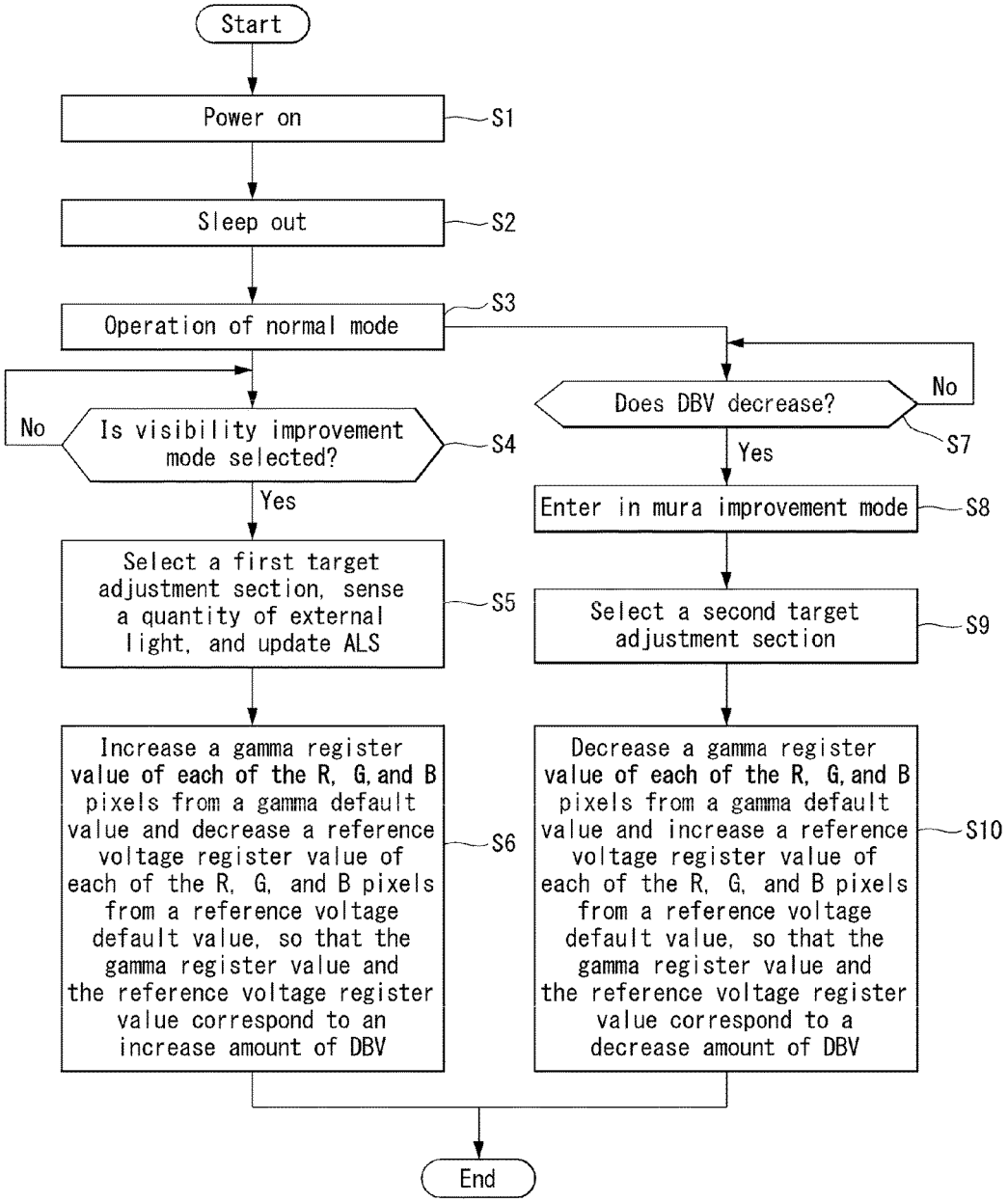
FIG. 18 is a flow chart showing a method for controlling a luminance of an OLED display according to an embodiment of the invention.
Figure 19:
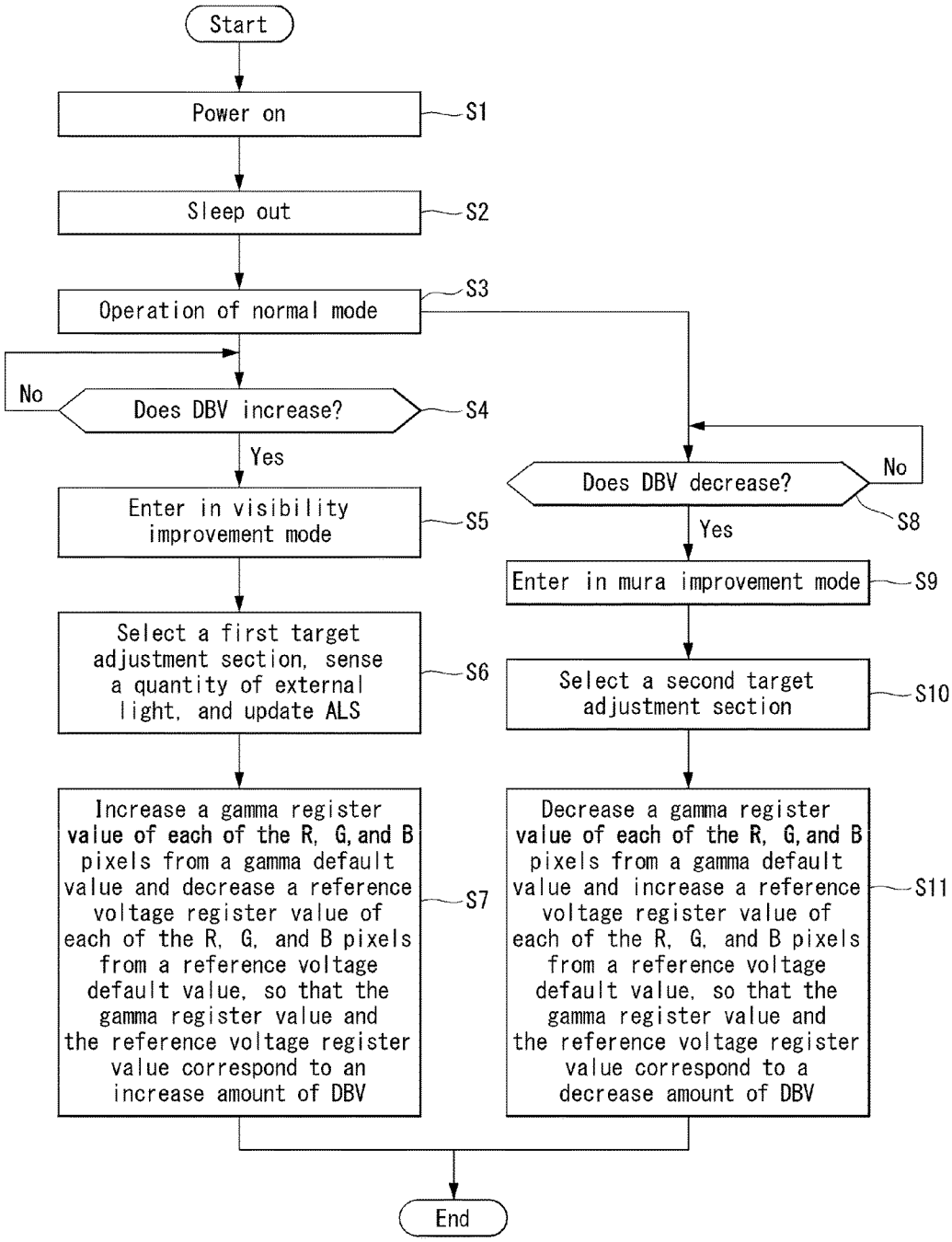
FIG. 19 is a flow chart showing another method for controlling a luminance of an OLED display according to an embodiment of the invention.

FIG. 18 is a flow chart showing a method for controlling the luminance of the OLED display according to the embodiment of the invention. FIG. 19 is a flow chart showing another method for controlling the luminance of the OLED display according to the embodiment of the invention.

Referring to FIG. 18, the method for controlling the luminance of the OLED display according to the embodiment of the invention, the system wakes up (i.e., comes out of sleep mode) when the driving power is turned on in step S1, and loads gamma register values and reference voltage register values of each band, which are previously set through the optical compensation, from the memory, in step S2.

The luminance control method according to the embodiment of the invention selects a band representing the second highest luminance among the previously set bands as a default band for the normal mode and implements a screen brightness corresponding to the default band if there is no user input information, in step S3.

The luminance control method according to the embodiment of the invention selects a first target adjustment section from the default band to an uppermost band representing a luminance higher than the default band when the visibility improvement mode is directly selected by the user, senses a quantity of external light, updates a digital illuminance information ALS, and outputs the digital illuminance information ALS as a screen brightness control signal, in steps S4 and S5.

The luminance control method according to the embodiment of the invention increases the gamma register values of each of the R, G, and B colors from a gamma default value of the default band based on the digital illuminance information ALS and decreases the reference voltage register values of each of the R, G, and B colors from a reference voltage default value of the default band based on the digital illuminance information ALS, in step S6.

The luminance control method according to the embodiment of the invention selects the mura prevention mode as the driving mode when a digital brightness value DBV decreases from the DBV default value of the default band by the screen brightness control of the user, in steps S7 and S8.

The luminance control method according to the embodiment of the invention selects a second target adjustment section from the default band to a lower band representing a luminance lower than the default band and outputs a decrease amount of the DBV as the screen brightness control signal, in step S9.

The luminance control method according to the embodiment of the invention decreases the gamma register value of each of the R, G, and B colors from the gamma default value of the default band and increases the reference voltage register value of each of the R, G, and B colors from the reference voltage default value of the default band, so that the gamma register value and the reference voltage register value correspond to the decrease amount of the DBV, in step S10.

The luminance control method according to the embodiment of the invention may include the following three steps so as to increase the reference voltage register value of each of the R, G, and B colors from the reference voltage default value of the default band. The first step is a step for dividing a difference between the R reference voltages belonging to the lower band and the default band by the decrease amount of the DBV, obtaining '1 step R reference voltage adjustment amount', and gradually increasing the R reference voltage register value by the 1 step R reference voltage adjustment amount at a predetermined interval. The second step is a step for dividing a difference between the G reference voltages belonging to the lower band and the default band by the decrease amount of the DBV, obtaining '1 step G reference voltage adjustment amount', and gradually increasing the G reference voltage register value by the 1 step G reference voltage adjustment amount at a predetermined interval. The third step is a step for dividing a difference between the B reference voltages belonging to the lower band and the default band by the decrease amount of the DBV, obtaining '1 step B reference voltage adjustment amount', and gradually increasing the B reference voltage register value by the 1 step B reference voltage adjustment amount at a predetermined interval.

Referring to FIG. 19, another method for controlling the luminance of the OLED display according to the embodiment of the invention, the system wakes up when the driving power is turned on in step S1, and loads gamma register values and reference voltage register values of each band, which are previously set through the optical compensation, from the memory, in step S2.

The luminance control method according to the embodiment of the invention selects a band representing the second highest luminance among the previously set bands as a default band for the normal mode and implements a screen brightness corresponding to the default band if there is no user input information, in step S3.

The luminance control method according to the embodiment of the invention selects the visibility improvement mode as the driving mode when a digital brightness value DBV increases from the DBV default value of the default band by the screen brightness control of the user, in steps S4 and S5.

The luminance control method according to the embodiment of the invention selects a first target adjustment section from the default band to an uppermost band representing a luminance higher than the default band and outputs a decrease amount of the DBV as the screen brightness control signal, in step S6.

The luminance control method according to the embodiment of the invention increases the gamma register value of each of the R, G, and B colors from the gamma default value of the default band and decreases the reference voltage register value of each of the R, G, and B colors from the reference voltage default value of the default band, so that the gamma register value and the reference voltage register value correspond to the decrease amount of the DBV, in step S7.

The luminance control method according to the embodiment of the invention may include the following three steps so as to decrease the reference voltage register value of each of the R, G, and B colors from the reference voltage default value of the default band. The first step is a step for dividing a difference between the R reference voltages belonging to the uppermost band and the default band by the increase amount of the DBV, obtaining '1 step R reference voltage adjustment amount', and gradually decreasing the R reference voltage register value by the 1 step R reference voltage adjustment amount at a predetermined interval. The second step is a step for dividing a difference between the G reference voltages belonging to the uppermost band and the default band by the increase amount of the DBV, obtaining '1 step G reference voltage adjustment amount', and gradually decreasing the G reference voltage register value by the 1 step G reference voltage adjustment amount at a predetermined interval. The third step is a step for dividing a difference between the B reference voltages belonging to the uppermost band and the default band by the increase amount of the DBV, obtaining '1 step B reference voltage adjustment amount', and gradually decreasing the B reference voltage register value by the 1 step B reference voltage adjustment amount at a predetermined interval.

The luminance control method according to the embodiment of the invention selects the mura prevention mode as the driving mode when the digital brightness value DBV decreases from the DBV default value of the default band by the screen brightness control of the user, in steps S8 and S9.

The luminance control method according to the embodiment of the invention selects a second target adjustment section from the default band to a lower band representing a luminance lower than the default band and outputs the decrease amount of the DBV as the screen brightness control signal, in step S10.

The luminance control method according to the embodiment of the invention decreases the gamma register value of each of the R, G, and B colors from the gamma default value of the default band and increases the reference voltage register value of each of the R, G, and B colors from the reference voltage default value of the default band, so that the gamma register value and the reference voltage register value correspond to the decrease amount of the DBV, in step S11.

Figure 21:
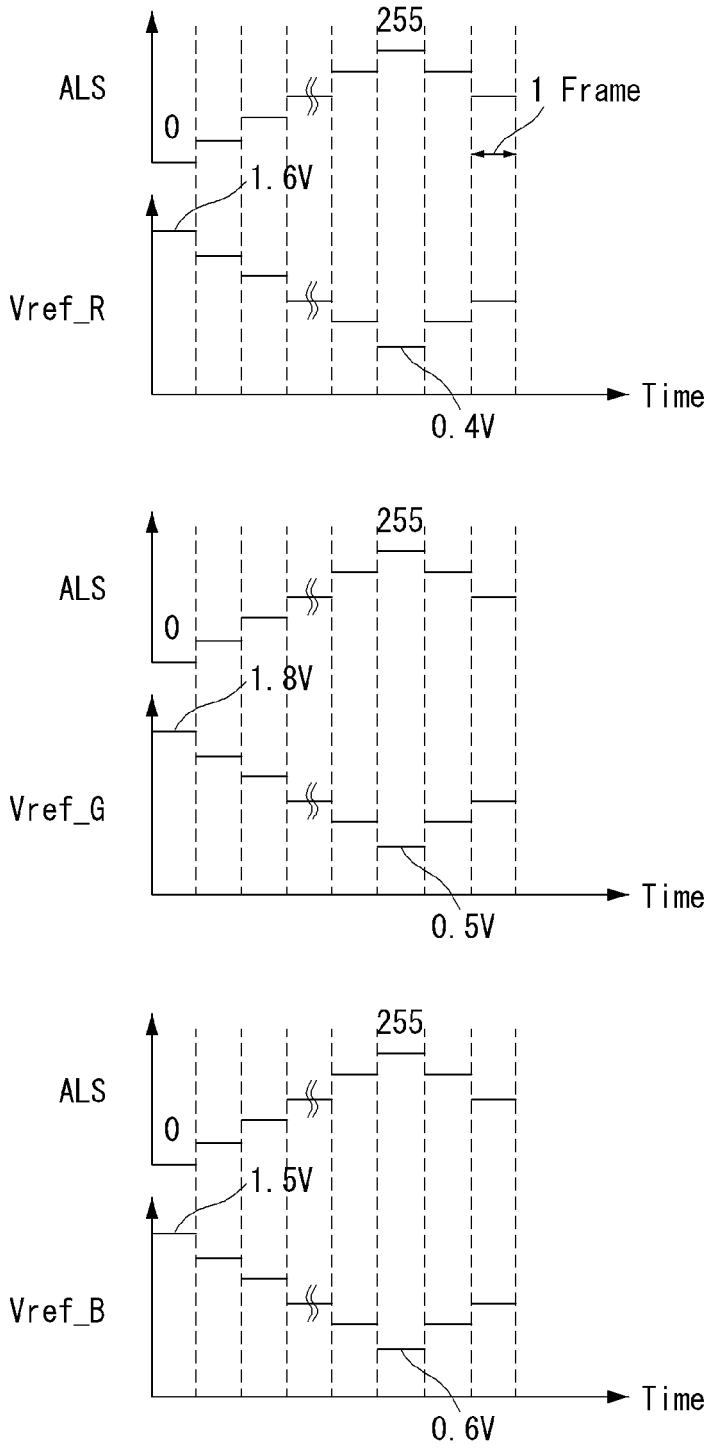
FIG. 21 shows an example where a reference voltage of each of R, G, and B colors is gradually adjusted depending on digital illuminance information at intervals of one frame according to an embodiment of the invention.
Figure 22:
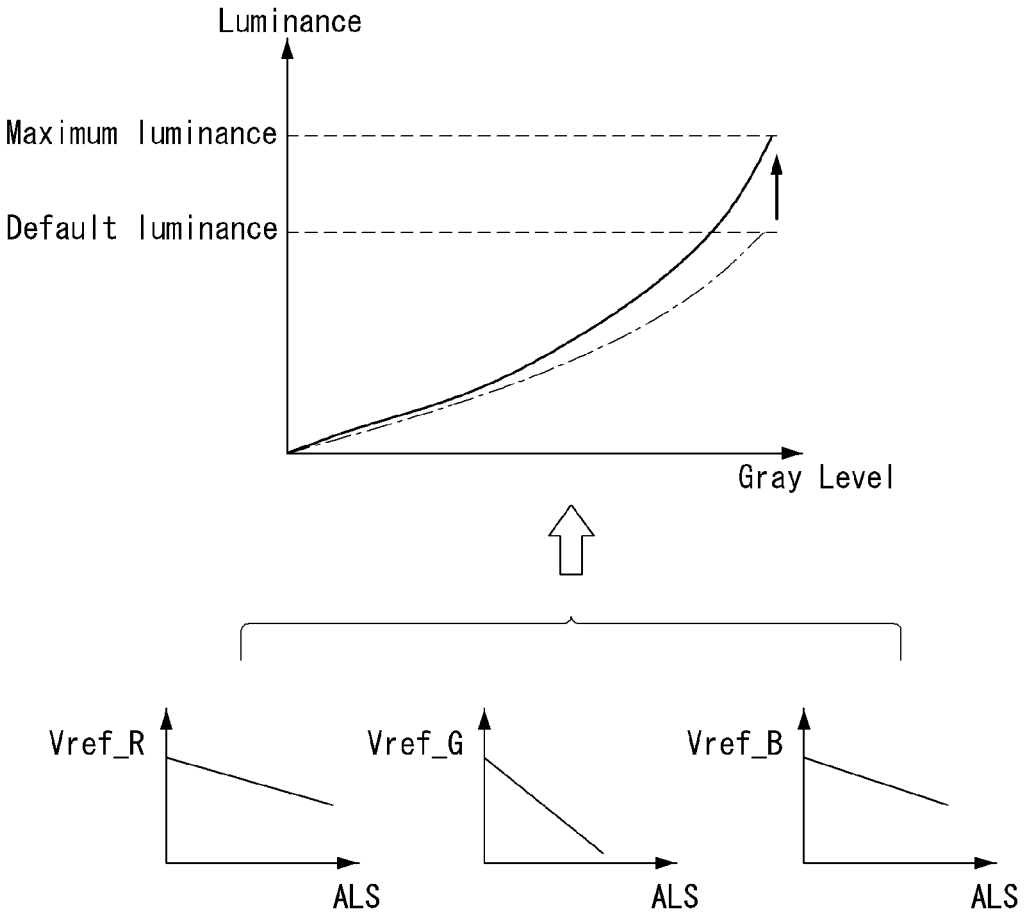
FIG. 22 illustrates effects obtained through the reference voltage adjustment at each of R, G, and B colors according to an embodiment of the invention.

FIG. 20 shows the reference voltages mapped to the digital illuminance information ALS at each of the R, G, and B colors in the luminance control method illustrated in FIG. 18. FIG. 21 shows an example where the reference voltage of each of the R, G, and B colors is gradually adjusted depending on the digital illuminance information ALS at intervals of one frame. FIG. 22 illustrates the effects obtained through the reference voltage adjustment at each of the R, G, and B colors.

As shown in FIGS. 20 and 21, the embodiments of the invention may map the reference voltages to the digital illuminance information ALS based on the quantity of external light and may gradually adjust the reference voltages Vref at each of the R, G, and B colors. The digital illuminance information ALS increases as the quantity of external light increases. When the digital illuminance information ALS increases, the reference voltage Vref may gradually decrease. The reference voltages Vref mapped to the digital illuminance information ALS may be differently set at each of the R, G, and B colors in consideration of the white balance and the color coordinates.

As shown in FIG. 22, the embodiments of the invention may easily implement a maximum luminance higher than a default luminance through the adjustment of the reference voltage Vref at each of the R, G, and B colors.

The effects of the embodiments of the invention are described below.

(1) The embodiments of the invention simultaneously adjust the reference voltage and the data voltage in the opposite direction without changing the gamma structure, and thus are advantageous for the size of the data driver and the power consumption without an increase in an output swing width of the data voltage for implementing the high luminance.

(2) The embodiments of the invention can easily implement the high luminance equal to or greater than 1000 nit without a loss of the grayscale. Further, the embodiments of the invention can simply implement the high luminance without adding a specific circuit or newly developing a driver integrated circuit (IC), and thus is efficient in a reduction in the manufacturing cost.

(3) The embodiments of the invention independently control the reference voltage at each of the R, G, and B colors, and thus can previously prevent or minimize the white balance and the color coordinates from being distorted when the luminance changes.

(4) The embodiments of the invention independently increase the reference voltage at each of the R, G, and B colors at the low luminance and reduce the decrease adjustment width of the data voltage for implementing the low luminance, thereby minimizing the mura visibility at the low luminance.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting diode display comprising:

pixels each including an organic light emitting diode, an amount of current flowing in the organic light emitting diode being determined depending on a difference between a data voltage and a reference voltage;

a control signal generator configured to differently generate a screen brightness control signal depending on a driving mode;

a register adjusting unit configured to independently adjust a reference voltage register value and a gamma register value from a reference voltage default value and a gamma default value, respectively, at each of red (R), green (G), and blue (B) colors depending on the screen brightness control signal;

a reference voltage generator configured to generate the reference voltage of each of the R, G, and B colors based on the adjusted reference voltage register value; and a data voltage generator configured to generate the data voltage of each of the R, G, and B colors based on the adjusted gamma register value, wherein the control signal generator loads a plurality of bands, which correspond to some of digital brightness values input from a user and in which optical compensation is previously set on the gamma register value and the reference voltage register value of each band, and wherein the register adjusting unit is further configured to:

in response to receiving the screen brightness control signal for an increase in brightness, increase the gamma register value of each of the R, G, and B colors from the gamma default value of a default band while decreasing the reference voltage register value of each of the R, G, and B colors from the reference voltage default value of the default band based on the digital brightness value.

2. The organic light emitting diode display of claim 1, wherein the control signal generator generates the screen brightness control signal depending on one of a normal mode, a visibility improvement mode, and a mura prevention mode, and wherein the band representing the second highest luminance among the plurality of bands is selected as the default band in the normal mode.

3. The organic light emitting diode display of claim 2, wherein when the visibility improvement mode is directly selected by the user, the control signal generator selects a first target adjustment section from the default band to an uppermost band representing the highest luminance, senses a quantity of external light, updates digital illuminance information, and outputs the digital illuminance information as the screen brightness control signal.

4. The organic light emitting diode display of claim 3, wherein the register adjusting unit increases the gamma register value of each of the R, G, and B colors from the gamma default value of the default band based on the digital illuminance information and decreases the reference voltage register value of each of the R, G, and B colors from the reference voltage default value of the default band based on the digital illuminance information.

5. The organic light emitting diode display of claim 2, wherein when the digital brightness value increases from a digital brightness default value of the default band by the screen brightness control of the user, the control signal generator selects the visibility improvement mode as the driving mode, selects a first target adjustment section from the default band to an uppermost band representing the highest luminance, and outputs an increase amount of the digital brightness value as the screen brightness control signal.

6. The organic light emitting diode display of claim 5, wherein the gamma register value and the reference voltage register value correspond to the increase amount of the digital brightness value.

7. The organic light emitting diode display of claim 6, wherein the register adjusting unit divides a difference between R reference voltages belonging to the uppermost band and the default band by the increase amount of the digital brightness value, obtains a 1 step R reference voltage adjustment amount, and gradually decreases an R reference voltage register value by the 1 step R reference voltage adjustment amount at a predetermined interval, wherein the register adjusting unit divides a difference between G reference voltages belonging to the uppermost band and the default band by the increase amount of the digital brightness value, obtains a 1 step G reference voltage adjustment amount, and gradually decreases a G reference voltage register value by the 1 step G reference voltage adjustment amount at a predetermined interval, and wherein the register adjusting unit divides a difference between B reference voltages belonging to the uppermost band and the default band by the increase amount of the digital brightness value, obtains a 1 step B reference voltage adjustment amount, and gradually decreases a B reference voltage register value by the 1 step B reference voltage adjustment amount at a predetermined interval.

8. The organic light emitting diode display of claim 2, wherein when the digital brightness value decreases from a digital brightness default value of the default band by the screen brightness control of the user, the control signal generator selects the mura prevention mode as the driving mode, selects a second target adjustment section from the default band to a lower band representing a luminance lower than the default band, and outputs a decrease amount of the digital brightness value as the screen brightness control signal.

9. The organic light emitting diode display of claim 8, wherein the register adjusting unit decreases the gamma register value of each of the R, G, and B colors from the gamma default value of the default band and increases the reference voltage register value of each of the R, G, and B colors from the reference voltage default value of the default band, so that the gamma register value and the reference voltage register value correspond to the decrease amount of the digital brightness value.

10. The organic light emitting diode display of claim 9, wherein the register adjusting unit divides a difference between R reference voltages belonging to the lower band and the default band by the decrease amount of the digital brightness value, obtains a 1 step R reference voltage adjustment amount, and gradually increases an R reference voltage register value by the 1 step R reference voltage adjustment amount at a predetermined interval, wherein the register adjusting unit divides a difference between G reference voltages belonging to the lower band and the default band by the decrease amount of the digital brightness value, obtains a 1 step G reference voltage adjustment amount, and gradually increases a G reference voltage register value by the 1 step G reference voltage adjustment amount at a predetermined interval, and wherein the register adjusting unit divides a difference between B reference voltages belonging to the lower band and the default band by the decrease amount of the digital brightness value, obtains a 1 step B reference voltage adjustment amount, and gradually increases a B reference voltage register value by the 1 step B reference voltage adjustment amount at a predetermined interval.

11. The organic light emitting diode display of claim 1, wherein the reference voltage generator includes:

a first reference voltage generator configured to generate an R reference voltage depending on an R reference voltage register value;

a second reference voltage generator configured to generate a G reference voltage depending on a G reference voltage register value; and a third reference voltage generator configured to generate a B reference voltage depending on a B reference voltage register value.

12. The organic light emitting diode display of claim 11, wherein the first reference voltage generator includes a first variable resistor which is connected between a first output node and a first division node and has a resistance varying depending on the R reference voltage register value, a first fixed resistor connected between the first division node and a ground level voltage source, and a first amplifier having an inverting terminal, to which an offset value is input, a non-inverting terminal connected to the first division node, and an output terminal connected to the first output node, wherein the second reference voltage generator includes a second variable resistor which is connected between a second output node and a second division node and has a resistance varying depending on the G reference voltage register value, a second fixed resistor connected between the second division node and the ground level voltage source, and a second amplifier having an inverting terminal, to which an offset value is input, a non-inverting terminal connected to the second division node, and an output terminal connected to the second output node, and wherein the third reference voltage generator includes a third variable resistor which is connected between a third output node and a third division node and has a resistance varying depending on the B reference voltage register value, a third fixed resistor connected between the third division node and the ground level voltage source, and a third amplifier having an inverting terminal, to which an offset value is input, a non-inverting terminal connected to the third division node, and an output terminal connected to the third output node.

13. The organic light emitting diode display of claim 11, wherein the reference voltage generator simultaneously applies the R, G, and B reference voltages to the R, G, and B pixels through first to third bus lines during a previously determined period.

14. The organic light emitting diode display of claim 11, wherein the reference voltage generator sequentially applies the R, G, and B reference voltages to the R, G, and B pixels through a common bus line during a previously determined period.

15. A method for controlling a luminance of an organic light emitting diode display including pixels, in which an amount of current flowing in an organic light emitting diode of each pixel is determined depending on a difference between a data voltage and a reference voltage, the method comprising:

differently generating a screen brightness control signal depending on a driving mode;

independently adjusting a reference voltage register value and a gamma register value from a reference voltage default value and a gamma default value, respectively, at each of red (R), green (G), and blue (B) pixels depending on the screen brightness control signal;

generating the reference voltage of each of the R, G, and B colors based on the adjusted reference voltage register value;

generating the data voltage of each of the R, G, and B colors based on the adjusted gamma register value, loading a plurality of bands, which correspond to some of digital brightness values input from a user and in which optical compensation is previously set on the gamma register value and the reference voltage register value of each band; and in response to receiving the screen brightness control signal for an increase in brightness, increasing the gamma register value of each of the R, G, and B colors from the gamma default value of a default band while decreasing the reference voltage register value of each of the R, G, and B colors from the reference voltage default value of the default band based on the digital brightness value.

16. The method of claim 15, further comprising:

selecting one of a normal mode, a visibility improvement mode, and a mura prevention mode, which are previously set, as the driving mode, wherein the band representing the second highest luminance among the plurality of bands is selected as the default band in the normal mode.

17. The method of claim 16, wherein when the visibility improvement mode is directly selected by the user, the differently generating of the screen brightness control signal depending on the driving mode includes:

selecting a first target adjustment section from the default band to an uppermost band representing the highest luminance;

sensing a quantity of external light to update digital illuminance information; and outputting the digital illuminance information as the screen brightness control signal.

18. The method of claim 17, wherein the independently adjusting of the reference voltage register value and the gamma register value at each of the R, G, and B colors depending on the screen brightness control signal further includes:

increasing the gamma register value of each of the R, G, and B colors from the gamma default value of the default band based on the digital illuminance information; and decreasing the reference voltage register value of each of the R, G, and B colors from the reference voltage default value of the default band based on the digital illuminance information.

19. The method of claim 16, wherein when the digital brightness value increases from a digital brightness default value of the default band by the screen brightness control of the user, the differently generating of the screen brightness control signal depending on the driving mode includes:

selecting the visibility improvement mode as the driving mode;

selecting a first target adjustment section from the default band to an uppermost band representing the highest luminance; and outputting an increase amount of the digital brightness value as the screen brightness control signal.

20. The method of claim 19, wherein the independently adjusting of the reference voltage register value and the gamma register value at each of the R, G, and B colors depending on the screen brightness control signal includes:

the increasing of the gamma register value of each of the R, G, and B colors from the gamma default value of the default band so that the gamma register value corresponds to the increase amount of the digital brightness value; and the decreasing of the reference voltage register value of each of the R, G, and B colors from the reference voltage default value of the default band so that the reference voltage register value corresponds to the increase amount of the digital brightness value.

21. The method of claim 20, wherein the decreasing of the reference voltage register value of each of the R, G, and B colors from the reference voltage default value of the default band so that the reference voltage register value corresponds to the increase amount of the digital brightness value, includes:

dividing a difference between R reference voltages belonging to the uppermost band and the default band by the increase amount of the digital brightness value, obtaining a 1 step R reference voltage adjustment amount, and gradually decreasing an R reference voltage register value by the 1 step R reference voltage adjustment amount at a predetermined interval;

dividing a difference between G reference voltages belonging to the uppermost band and the default band by the increase amount of the digital brightness value, obtaining a 1 step G reference voltage adjustment amount, and gradually decreasing a G reference voltage register value by the 1 step G reference voltage adjustment amount at a predetermined interval; and dividing a difference between B reference voltages belonging to the uppermost band and the default band by the increase amount of the digital brightness value, obtaining a 1 step B reference voltage adjustment amount, and gradually decreasing a B reference voltage register value by the 1 step B reference voltage adjustment amount at a predetermined interval.

22. The method of claim 16, wherein when the digital brightness value decreases from a digital brightness default value of the default band by the screen brightness control of the user, the differently generating of the screen brightness control signal depending on the driving mode includes:

selecting the mura prevention mode as the driving mode;

selecting a second target adjustment section from the default band to a lower band representing a luminance lower than the default band; and outputting a decrease amount of the digital brightness value as the screen brightness control signal.

23. The method of claim 22, wherein the independently adjusting of the reference voltage register value and the gamma register value at each of the R, G, and B colors depending on the screen brightness control signal includes:

decreasing the gamma register value of each of the R, G, and B colors from the gamma default value of the default band so that the gamma register value corresponds to the decrease amount of the digital brightness value; and increasing the reference voltage register value of each of the R, G, and B colors from the reference voltage default value of the default band so that the reference voltage register value corresponds to the decrease amount of the digital brightness value.

24. The method of claim 23, wherein the increasing of the reference voltage register value of each of the R, G, and B colors from the reference voltage default value of the default band so that the reference voltage register value corresponds to the decrease amount of the digital brightness value, includes:

dividing a difference between R reference voltages belonging to the lower band and the default band by the decrease amount of the digital brightness value, obtaining a 1 step R reference voltage adjustment amount, and gradually increasing an R reference voltage register value by the 1 step R reference voltage adjustment amount at a predetermined interval, dividing a difference between G reference voltages belonging to the lower band and the default band by the decrease amount of the digital brightness value, obtaining a 1 step G reference voltage adjustment amount, and gradually increasing a G reference voltage register value by the 1 step G reference voltage adjustment amount at a predetermined interval; and dividing a difference between B reference voltages belonging to the lower band and the default band by the decrease amount of the digital brightness value, obtaining a 1 step B reference voltage adjustment amount, and gradually increasing a B reference voltage register value by the 1 step B reference voltage adjustment amount at a predetermined interval.

25. An organic light emitting diode display comprising:

pixels each including an organic light emitting diode, an amount of current flowing in the organic light emitting diode being determined depending on a difference between a data voltage and a reference voltage;

a control signal generator configured to differently generate a screen brightness control signal depending on a driving mode;

a register adjusting unit configured to independently adjust a reference voltage register value and a gamma register value at each of red (R), green (G), and blue (B) colors depending on the screen brightness control signal;

a reference voltage generator configured to generate the reference voltage of each of the R, G, and B colors based on the adjusted reference voltage register value; and a data voltage generator configured to generate the data voltage of each of the R, G, and B colors based on the adjusted gamma register value, wherein the reference voltage generator includes:

a first reference voltage generator configured to generate an R reference voltage depending on an R reference voltage register value;

a second reference voltage generator configured to generate a G reference voltage depending on a G reference voltage register value; and a third reference voltage generator configured to generate a B reference voltage depending on a B reference voltage register value.

* * * * *